US011168527B2

(12) United States Patent
Johnson et al.

(10) Patent No.: US 11,168,527 B2
(45) Date of Patent: Nov. 9, 2021

(54) APPARATUSES AND METHODS FOR LOCATING AND SHIFTING A DOWNHOLE FLOW CONTROL MEMBER

(71) Applicant: NCS Multistage Inc., Calgary (CA)

(72) Inventors: Tim Johnson, Calgary (CA); Michael Werries, Calgary (CA)

(73) Assignee: NCS Multistage Inc., Calgary (CA)

( * ) Notice: Subject to any disclaimer, the term of this patent is extended or adjusted under 35 U.S.C. 154(b) by 0 days.

(21) Appl. No.: 16/574,842

(22) Filed: Sep. 18, 2019

(65) Prior Publication Data

US 2020/0063513 A1 Feb. 27, 2020

Related U.S. Application Data

(63) Continuation of application No. 15/586,975, filed on May 4, 2017, now Pat. No. 10,458,195.

(60) Provisional application No. 62/331,706, filed on May 4, 2016.

(51) Int. Cl.

| | |
|---|---|
| ***E21B 23/02*** | (2006.01) |
| ***E21B 23/00*** | (2006.01) |
| ***E21B 47/09*** | (2012.01) |
| ***E21B 23/01*** | (2006.01) |

(52) U.S. Cl.

CPC ..... *E21B 23/02* (2013.01); *E21B 23/006* (2013.01); *E21B 23/01* (2013.01); *E21B 47/09* (2013.01)

(58) Field of Classification Search

CPC ..... E21B 23/006; E21B 23/02

See application file for complete search history.

(56) References Cited

U.S. PATENT DOCUMENTS

| | | | | |
|---|---|---|---|---|
| 2,568,867 | A | 9/1951 | Herbert | |
| 2,980,185 | A * | 4/1961 | Daffin | E21B 23/02 166/211 |
| 3,593,784 | A | 7/1971 | Brown | |
| 4,344,651 | A * | 8/1982 | Longacre | E21B 23/006 166/196 |
| 4,554,972 | A | 11/1985 | Merritt | |
| 5,366,019 | A | 11/1994 | Brooks | |
| 6,152,219 | A | 11/2000 | Vick | |

(Continued)

FOREIGN PATENT DOCUMENTS

| | | |
|---|---|---|
| CA | 2916422 | 6/2016 |

OTHER PUBLICATIONS

International Search Report and Written Opinion issued in PCT/CA2017/000112 dated Nov. 11, 2017.

*Primary Examiner* — Giovanna Wright
(74) *Attorney, Agent, or Firm* — Ridout and Maybee LLP

(57) ABSTRACT

There is provided a downhole tool comprising a locator. The locator includes a wellbore coupler for becoming releasably retained relative to a locate profile; and a wellbore coupler release opposer configured for opposing release of the wellbore coupler from the retention relative to the locate profile. While the opposing of the release of the wellbore coupler from the retention relative to the locate profile is being effected by the wellbore coupler release opposer, relative displacement between the wellbore coupler release opposer and the wellbore coupler is effectible, with effect that the opposing is defeated. The locator also includes a displacement impeder for impeding the relative displacement between the wellbore coupler release opposer and the wellbore coupler.

16 Claims, 22 Drawing Sheets

(56) References Cited

U.S. PATENT DOCUMENTS

| | | | |
|---|---|---|---|
| 2013/0333883 | A1 | 12/2013 | Ehtesham et al. |
| 2016/0090803 | A1 | 3/2016 | Getzlaf et al. |
| 2018/0100366 | A1 | 4/2018 | Johnson |
| 2018/0171734 | A1 | 6/2018 | Johnson |

* cited by examiner 600
200
C
B
620
420
304
300
302
502
504
216
700
206
510

201B
417
420
416
424
308
422
410A
404
406
408
402A
402B
302B
302A
402
218
712
704
710
506
208
210A
210

201
614
616
630
606
610
618
602
622
608
601
604
612
620
632
200B
204
621
420

600
620
420
410
308
406
402
202
218
700
200
208
210

APPARATUSES AND METHODS FOR LOCATING AND SHIFTING A DOWNHOLE FLOW CONTROL MEMBER

CROSS-REFERENCE TO RELATED APPLICATIONS

This application is a continuation of U.S. patent application Ser. No. 15/586,975 filed May 4, 2017 under the title "APPARATUSES AND METHODS FOR LOCATING AND SHIFTING A DOWNHOLE FLOW CONTROL MEMBER", which in turn claims priority to U.S. provisional patent application No. 62/331,706 filed May 4, 2016 under the title "APPARATUSES AND METHODS FOR LOCATING A WELLBORE", the contents of which are hereby expressly incorporated by reference into the present application.

FIELD

The present disclosure relates to locators for effecting positioning of tools within a wellbore.

BACKGROUND

It is often desirable to position a tool within a wellbore in order to perform a wellbore operation, such as perforating a casing, or sliding a sleeve for opening and closing a port in order to effect hydraulic fracturing and, subsequently, to receive hydrocarbons from a reservoir.

Contemporary wells often extend over significant distances and may be characterized by significant deviation. In order for a locator to be positioned at or near the extremities of such wells, the locator is configured so as not to offer significant resistance while it is being deployed downhole. However, with a conventional locator, in minimizing its frictional resistance, the reliability of a locator in locating a wellbore, and enabling proper positioning of a tool for a downhole operation, suffers. This is because successful locating is often indicated by sensed resistance to overpull applied to the workstring, and there is greater risk that overpull, in circumstances where the locator is configured to offer minimal resistance while travelling though the well, may be confused with other forces that are merely dislodging the workstring from another form of interference within the wellbore.

SUMMARY

In one aspect, there is provided a downhole tool comprising:

a locator including:

a wellbore coupler for becoming releasably retained relative to a locate profile; and a wellbore coupler release opposer configured for opposing release of the wellbore coupler from the retention relative to the locate profile;

wherein, the wellbore coupler and the wellbore coupler displacement-opposing member are co-operatively configured such that, while the opposing of the release of the wellbore coupler from the retention relative to the locate profile is being effected by the wellbore coupler release opposer, relative displacement between the wellbore coupler release opposer and the wellbore coupler is effectible, with effect that the opposing is defeated;

and a displacement impeder for impeding the relative displacement between the wellbore coupler release opposer and the wellbore coupler;

wherein the wellbore coupler release opposer and the displacement impeder are relatively positionable such that:

while:

the wellbore coupler release opposer and the displacement impeder are co-operatively disposed in a first orientation;

the wellbore coupler is releasably retained relative to the locate profile;

release of the wellbore coupler from retention relative to the locate profile is being opposed by the wellbore coupler release opposer;

relative displacement between the wellbore coupler release opposer and the wellbore coupler is being effected while the release is being opposed by the wellbore coupler release opposer;

the relative displacement between the wellbore coupler release opposer and the wellbore coupler, while the release is being opposed by the wellbore coupler release opposer, is impeded by the displacement impeder;

and while:

the wellbore coupler release opposer and the displacement impeder are co-operatively disposed in a second orientation;

the wellbore coupler is releasably retained relative to the locate profile; and release of the wellbore coupler from retention relative to the locate profile is being opposed by the wellbore coupler release opposer;

relative displacement between the wellbore coupler release opposer and the wellbore coupler, is being effected while the release is being opposed by the wellbore coupler release opposer;

impeding of the relative displacement between the wellbore coupler release opposer and the wellbore coupler, by the displacement impeder, while the release is being opposed by the wellbore coupler release opposer, is prevented or substantially prevented.

In another aspect, there is provided a downhole tool comprising:

a locator including:

a wellbore coupler displaceable between an extended position and a retracted position; and a wellbore coupler displacement-opposing member configured for opposing displacement of the wellbore coupler from the extended position to the retracted position;

wherein, the wellbore coupler and the wellbore coupler displacement-opposing member are co-operatively configured such that, while the opposing of the displacement of the wellbore coupler from the extended position to the retracted position is being effected by the wellbore coupler displacement-opposing member, relative displacement between the wellbore coupler displacement-opposing member and the wellbore coupler is effectible, with effect that the opposing is defeated;

and a displacement impeder for impeding the relative displacement between the wellbore coupler displacement-opposing member and the wellbore coupler;

wherein the wellbore coupler displacement-opposing member and the displacement impeder are relatively positionable such that:

while:

the wellbore coupler displacement-opposing member and the displacement impeder are co-operatively disposed in a first orientation;

the wellbore coupler is disposed in the extended position; and displacement of the wellbore coupler from the extended position to the retracted position is being opposed by the wellbore coupler displacement-opposing member; and relative displacement between the wellbore coupler displacement-opposing member and the wellbore coupler is being effected while the displacement of the wellbore coupler to the retracted position is being opposed by the wellbore coupler displacement-opposing member;

the relative displacement between the wellbore coupler displacement-opposing member and the wellbore coupler, while the displacement of the wellbore coupler to the retracted position is being opposed by the wellbore coupler displacement-opposing member, is impeded by the displacement impeder;

and while:

the wellbore coupler displacement-opposing member and the displacement impeder are co-operatively disposed in a second orientation;

the wellbore coupler is disposed in the extended position; and displacement of the wellbore coupler from the extended position to the retracted position is being opposed by the wellbore coupler displacement-opposing member; and relative displacement between the wellbore coupler displacement-opposing member and the wellbore coupler, is being effected while the displacement of the wellbore coupler to the retracted position is being opposed by the wellbore coupler displacement-opposing member;

impeding of the relative displacement between the wellbore coupler displacement-opposing member and the wellbore coupler, by the displacement impeder, while the displacement of the wellbore coupler to the retracted position is being opposed by the wellbore coupler displacement-opposing member, is prevented or substantially prevented.

BRIEF DESCRIPTION OF DRAWINGS

The preferred embodiments will now be described with the following accompanying drawings, in which.

DETAILED DESCRIPTION

Figure 1:
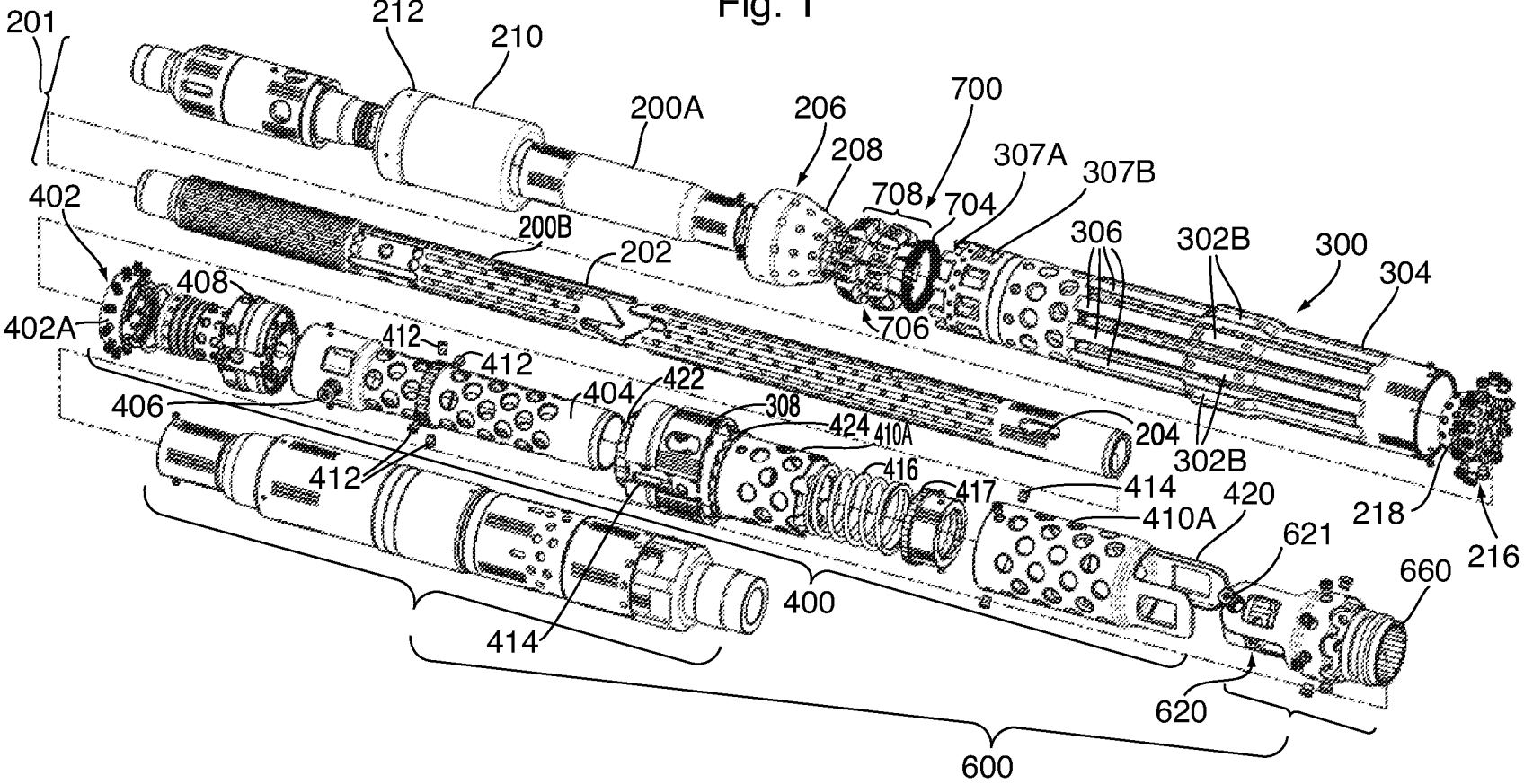
FIG. 1 is an exploded perspective view of an embodiment of a shifting tool of the present disclosure.

Referring to FIGS. 1 and 30, a shifting tool 100 is provided. In some embodiments, for example, the shifting tool 100 is part of a wellbore tool, such as a bottomhole assembly, that has other functionalities. The shifting tool 100 is conveyable within a wellbore 500 via a conveyance member 201.

The conveyance member 201 is configured for coupling to a workstring 220. The workstring 220 is deployable within a wellbore 500 that extends into a subterranean formation 100. In this respect, the conveyance member 201 is translatable with the workstring 220 and is, therefore, moveable through the wellbore 500 in response to a force being applied to the workstring 220.

Figure 4:
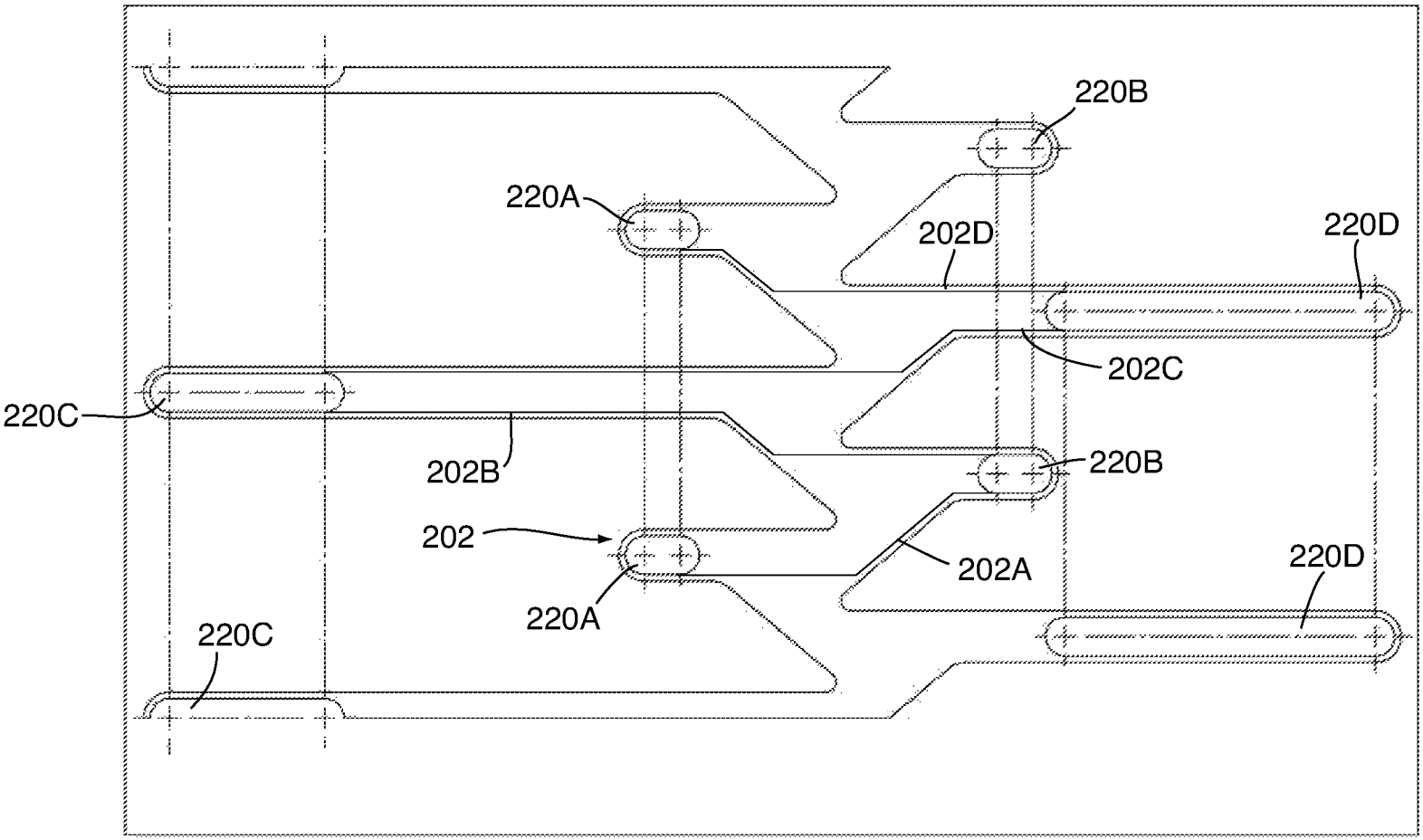
FIG. 4 is an unwrapped view of a j-slot of the shifting tool illustrated in FIG. 1.

In some embodiments, for example, the conveyance member 201 includes a conveyance member 201. The conveyance member 201 includes upper and lower mandrel sections 200A, 200B that are threaded to one another. The conveyance member 201 is coupled to the wellbore coupler release opposer 400 via a j-slot 202 (see FIG. 4) formed within the conveyance member 201.

The shifting tool 100 includes a locator 300.

The locator 300 includes a wellbore coupler 304. The wellbore coupler 304 is slidably mounted about the conveyance member 201 and retained relative to the conveyance member 201 relative to uphole and downhole stops 422, 424, as described below.

The wellbore coupler 304 is provided for becoming releasably retained relative to a wellbore feature 502 within the wellbore 500, such as, for example, a locate profile 502 defined within a wellbore string, such as, for example, a casing string. The wellbore coupler 304 includes an engagement member 302, and the engagement member 302 includes a protuberance 302A, such as a locator block 302B, for disposition within the wellbore feature 502 (such as, for example, the locate profile 502). The releasable retention is such that, while the engagement member 302 is disposed within the locate profile 502, relative displacement between the wellbore coupler 304 and the locate profile 502 (or other wellbore feature), such as along an axis that is parallel, or substantially parallel, to the central longitudinal axis of the wellbore 500, is at least impeded. In some embodiments, for example, the engagement member 302 extends outwardly relative to the central longitudinal axis of the conveyance member 201.

In some embodiments, for example, the locator block 302B is sufficiently large such that inadvertent locating of the locator block 302B within a recess of the wellbore 500 (such as a recess within the wellbore string 504, for example, a casing string), other than the locate profile 502, is avoided.

While the wellbore coupler 304 is releasably retained relative to the locate profile 502, the wellbore coupler 304 is disposed in the locating position and the engagement member 302 is disposed within the locate profile 502. While the wellbore coupler 304 is released from retention relative to the locate profile 502, the wellbore coupler 304 is disposed in the retracted position and the engagement member 302 is retracted relative to the locate profile 502. In some embodiments, for example, the displaceability of the engagement member 302 from the retracted position to disposition within the locate profile 502 is outwardly relative to the central longitudinal axis of the wellbore 500, or the central longitudinal axis of the conveyance member 201, or both, such as along an axis that is orthogonal, or substantially orthogonal, relative to the central longitudinal axis of the wellbore 500, or the central longitudinal axis of the conveyance member 201, or both. In some embodiments, for example, the displaceability of the engagement member 302 from disposition within the locate profile 502 to the retracted position is inwardly relative to the central longitudinal axis of the wellbore 500, or the central longitudinal axis 201A of the conveyance member 201, or both, such as along an axis that is orthogonal, or substantially orthogonal, relative to the central longitudinal axis of the wellbore 500, or the central longitudinal axis of the conveyance member 201, or both.

The engagement member 302 is biased towards disposition within the locate profile 502. In this respect, in some embodiments, for example, the wellbore coupler 304 includes one or more resilient members that exert a biasing force for effecting the biasing of the locator block 302B for disposition within the locate profile 502. In some embodiments, for example, the resilient members 304 are in the form of collet springs (for example, beam springs), that are separated by slots. In some contexts, the collet springs 306 may be referred to as collet fingers. In some embodiments, for example, a locator block 302B is disposed on one or more of the collet springs 306. In some embodiments, for example, the locator block 302B is defined as a protuberance 302A extending from the collet spring 306.

In some embodiments, for example, the collet springs 306 are configured for a limited amount of compression in response to a compressive force applied inwardly relative to a longitudinal axis of the mandrel. Because of their resiliency, the collet springs 306 are able to pass by a restriction in a wellbore 500 while returning to its original shape.

In this respect, when the locator block 302B becomes aligned with the locate profile 502, after traversing a portion of the wellbore 500 while in a compressed state, the collet springs 306 expand such that the locator block 302B is displaced outwardly relative to the central longitudinal axis of wellbore 500, towards the locate profile 502, for disposition within the locating position such that the wellbore coupler 304 becomes releasably retained relative to the locate profile 502.

Co-operatively, the locate profile 502 is shaped (for example, tapered inwardly towards the central longitudinal axis of the wellbore 500, such as, for example, at its uphole end) so as to encourage the displacement of the locator block 302B from the locate profile 502 (such that the wellbore coupler 304 is displaced from the locating position to the retracted position). In some embodiments, for example, the locate profile 502 is tapered, at its uphole end, at an angle of between 40 degrees and 90 degrees relative to the longitudinal axis of the wellbore 500. In some embodiments, for example, comparatively, the locate profile 502 is tapered at its downhole end at an angle of between 5 degrees and 90 degrees relative to the longitudinal axis of the wellbore 500. In this respect, the force required to release the wellbore coupler 304 from retention by the locate profile 302 is relatively less while the locator 300 is being run-in-hole than while the locator 300 is being pulled up-hole. By configuring the locate profile 502 in this manner, the locate profile 502 does not significantly impede the running-in-hole of the locator 300, while being available to releasably retain the wellbore coupler 304 as the locator 300 is being pulled-out-of hole and contribute to withstanding such release until a sufficient force, that is noticeable at the surface 102, is applied to the wellbore coupler 304.

The locator 300 also includes a wellbore coupler release opposer 400 for opposing release of the wellbore coupler 304 from retention relative to the wellbore feature 502 (such as, for example, the locate profile 502).

In some embodiments, for example, the wellbore coupler opposer 400 is received by an axial passageway defined within the wellbore coupler 304 and is displaceable relative to the wellbore coupler 304. The wellbore coupler release opposer 400 defines an axial passageway which receives the conveyance member 201. Coupling of the wellbore coupler release opposer 400 and the conveyance member 201 is mediated by a j-tool, as described below.

In some embodiments, for example, where the wellbore feature 502 is a locate profile 502, the opposing of the release of the wellbore coupler 304 from retention relative to the locate profile 502 is effected while the engagement member 302 is disposed within the locate profile 502.

In some embodiments, for example, the opposing of the release of the wellbore coupler 304 from retention relative to the wellbore feature 502 includes opposing displacement of the wellbore coupler 304 from the locating position to the retracted position. In this respect, in some embodiments, for example, the wellbore coupler release opposer 400 includes a wellbore coupler displacement-opposing member 402 for opposing displacement of the wellbore coupler 304 from the locating position to the retracted position. In some embodiments, for example, the opposing of the displacement is being effected while the engagement member 302 is disposed within the locate profile 502. In some embodiments, for example, the opposing of the displacement is being effected while support of the engagement member 302 is being effected by the wellbore coupler release opposer 400. In some embodiments, for example, the opposing of the displacement is being effected while the engagement member 302 is seated on the wellbore coupler release opposer 400. In some embodiments, for example, the wellbore coupler 304 includes a protuberance 302A depending therefrom, wherein the seating of the engagement member 302 is effected by the seating of the protuberance 302A on the wellbore coupler release opposer 400. The protuberance 302A is disposed on a side of the wellbore coupler 304 that is opposite to the side of the wellbore coupler 304 on which the engagement member 302 (such as another protuberance, such as, for example, the locator block 302B) is disposed. In some embodiments, for example, the protuberance 302A extends inwardly relative to the central longitudinal axis of the conveyance member 201 (or, towards the central longitudinal axis of the conveyance member 201). In some embodiments, for example, the protuberance 302A is aligned with the engagement member 302, In some embodiments, for example, the opposing of the displacement of the wellbore coupler 304 from the locating position to the retracted position includes opposing of the displacement of the engagement member 302 from an extended position (such as, for example, from disposition within the locate profile 502) to a retracted position. While the displacement of the engagement member 302 from the extended position (such as, for example, from disposition within the locate profile 502) to the retracted position is being opposed by the wellbore coupler release opposer 400 (i.e. by the wellbore coupler displacement-opposing member 402), the engagement member 302 and the wellbore coupler displacement-opposing member 402 are displaceable relative to one another for effecting a change in condition of the engagement member 302 such that the engagement member 302 becomes displaceable to the retracted position, such as, for example, in response to a sufficient uphole pulling force. In this respect, in some embodiments, for example, while the displacement of the engagement member 302 from the extended position (such as, for example, from disposition within the locate profile 502) to the retracted position is being opposed by the wellbore coupler release opposer 400 (i.e. by the wellbore coupler displacement-opposing member 402) the wellbore coupler displacement-opposing member 402 is displaceable relative to the engagement member 302 for effecting a change in condition of the engagement member 302 such that the engagement member 302 becomes displaceable to the retracted position, such as, for example, in response to a sufficient uphole pulling force. In some embodiments, for example, while the displacement of the engagement member 302 from the extended position (such as, for example, from disposition within the locate profile 502) to the retracted position is being opposed by the wellbore coupler release opposer 400 (i.e. by the wellbore coupler displacement-opposing member 402), the engagement member 302 is displaceable relative to the wellbore coupler displacement-opposing member 402 for effecting a change in condition of the engagement member 302 such that the engagement member 302 becomes displaceable to the retracted position, such as, for example, in response to a sufficient uphole pulling force. In some embodiments, for example, while the displacement of the engagement member 302 from the extended position (such as, for example, from disposition within the locate profile 502) to the retracted position is being opposed by the wellbore coupler release opposer 400 (i.e. by the wellbore coupler displacement-opposing member 402), the wellbore coupler displacement-opposing member 402 is displaceable relative to the engagement member 302, and the engagement member 302 is also displaceable relative to the wellbore coupler displacement-opposing member 402 for effecting a change in condition of the engagement member 302 such that the engagement member 302 becomes displaceable to the retracted position, such as, for example, in response to a sufficient uphole pulling force.

In some embodiments, for example, the effecting a change in condition of the engagement member 302 includes defeating the opposing of the displacement of the engagement member 302, relative to the wellbore feature 502, by the locator displacement-opposing member 402. In some embodiments, for example, the defeating includes effecting positioning of the engagement member 302 relative to the wellbore coupler displacement-opposing member 402 such that there is an absence, or substantial absence, of opposition to the displacement of the engagement member 302, by the wellbore coupler displacement-opposing member 402, from the extended position (such as, for example, from disposition within the locate profile 502) to the retracted position. In some embodiments, for example, the defeating includes effecting positioning of the engagement member 302 relative to the wellbore coupler displacement-opposing member 402 such that there is an absence, or substantial absence, of interference to the displacement of the engagement member 302, by the wellbore coupler displacement-opposing member 402, from the extended position (such as, for example, from disposition within the locate profile 502) to the retracted position. In some embodiments, for example, the defeating includes effecting positioning of the engagement member 302 relative to the wellbore coupler displacement-opposing member 402 such that there is an absence, or substantial absence, of supporting of the engagement member 302 by the wellbore coupler displacement-opposing member 402. In some embodiments, for example, the defeating includes effecting positioning of the engagement member 302 relative to the wellbore coupler displacement-opposing member 402 such that there is an absence, or substantial absence, of engagement of the engagement member 302 by the wellbore coupler displacement-opposing member 402. In some embodiments, for example, the opposing of the displacement is being effected while the engagement member 302 is seated on the wellbore coupler displacement-opposing member 402; and the effecting a change in condition of the engagement member 302 includes unseating of the engagement member 302 relative to the wellbore coupler displacement-opposing member 402.

In some embodiments, for example, while the displacement of the engagement member 302 from the extended position (such as, for example, from disposition within the locate profile 502) to the retracted position is being opposed, the displaceability of at least one of the engagement member 302 and the wellbore coupler displacement-opposing member 402, relative to the other one of the engagement member 302 and the wellbore coupler displacement-opposing member 402, for the defeating of the opposing, is effected by displaceability of one of the engagement member 302 and the wellbore coupler displacement-opposing member 402 relative to the other one of the engagement member 302 and the wellbore coupler displacement-opposing member 402 along an axis that is transverse (such as, for example, orthogonal or substantially orthogonal) to the axis along which the engagement member 302 is displaceable, relative to the locate profile 502, from the extended position (such as, for example, from disposition within the locate profile 502) to the retracted position. In some embodiments, for example, the displaceability of one of the engagement member 302 and the wellbore coupler displacement-opposing member 402 relative to the other one of the engagement member 302 and the wellbore coupler displacement-opposing member 402, for the defeating the opposing, is along an axis that is parallel, or substantially parallel, to the central longitudinal axis 201B of the conveyance member 201.

In some embodiments, for example, while the displacement of the engagement member 302 to the retracted position is being opposed, the displaceability, of at least one of the engagement member 302 and the wellbore coupler displacement-opposing member 402, relative to the other one of the engagement member 302 and the wellbore coupler displacement-opposing member 402, for the defeating of the opposing, is effected by displaceability of the wellbore coupler displacement-opposing member 402 relative to the engagement member 302. In this respect, in some embodiments, for example, the wellbore coupler displacement-opposing member 402 is displaceable relative to the engagement member 302, while the displacement of the engagement member 302 to the retracted position is being opposed, for defeating the opposing. In some embodiments, for example, the displaceability of the wellbore coupler displacement-opposing member 402 relative to the engagement member 302 is along an axis that is transverse to the axis along which the engagement member 302 is displaceable, relative to the locate profile 502, from the locate profile to the retracted position. In some embodiments, for example, the displaceability of the wellbore coupler displacement-opposing member 402 relative to the engagement member 302 is along an axis that is orthogonal, or substantially orthogonal, to the axis along which the engagement member 302 is displaceable, relative to the locate profile 502, from the locate profile 502 to the retracted position. In some embodiments, for example, the displaceability of the wellbore coupler displacement-opposing member 402, relative to the engagement member 302, is along an axis that is parallel, or substantially parallel, to the central longitudinal axis 201A of the conveyance member 201.

In some embodiments, for example, the opposing is defeated in response to displacement of the wellbore coupler displacement-opposing member 402 relative to the wellbore coupler 304 along an axis that is transverse (e.g. orthogonal or substantially orthogonal) to the axis along which the engagement member 302 is displaceable, relative to the locate profile 502, to the retracted position.

In some embodiments, for example, the opposing is defeated in response to displacement of the wellbore coupler displacement-opposing member 402 relative to the wellbore coupler 304 along an axis that is parallel, or substantially parallel, to the central longitudinal axis of the wellbore 500, or along an axis that is parallel, or substantially parallel, to the central longitudinal axis of the conveyance member 201, or both.

In some embodiments, for example, the wellbore coupler displacement-opposing member 402 extends in an outwardly direction relative to the central longitudinal axis of the conveyance member 201.

In some embodiments, for example, the wellbore coupler displacement-opposing member 402 is coupled relative to the conveyance member 201 with a frangible coupling, such as a shear pin. This enables shearing of the wellbore coupler displacement-opposing member 402 in the event that the wellbore coupler 304, while seated on the wellbore coupler displacement-opposing member 402, becomes friction locked within the wellbore 500, and thereby enable the wellbore coupler 304 to continue moving within the wellbore 500.

In some embodiments, for example, the opposing of the release of the wellbore coupler 304 from retention relative to the wellbore feature 502 (such as, for example the locate profile 502), by the wellbore coupler release opposer 400, includes preventing release of the wellbore coupler 304 from retention relative to the locate profile 502. In some embodiments, for example, the preventing of the release of the wellbore coupler 304 from retention relative to the wellbore feature 502 includes preventing displacement of the engagement member 302 from an extended position (such as, for example, (while the engagement member 302 is disposed within the locate profile 502, such as, for example, while the wellbore coupler 304 is being releasably retained by the locate profile 502) to the retracted position (such as, for example, while the wellbore coupler 304 is released from retention relative to the wellbore feature 502).

In some embodiments, for example, the opposing of the release of the wellbore coupler 304 from retention relative to the wellbore feature 502 (such as, for example the locate profile 502), by the wellbore coupler release opposer 400, includes impeding release of the wellbore coupler 304 from retention relative to the wellbore feature 502. Exemplary embodiments where the impeding of the release of the wellbore coupler 304 from retention relative to the wellbore feature 502 (such as, for example, the locate profile 502) are described in International Application No. PCT/CA2016/000278.

The shifting tool 100 also includes a displacement impeder 600 for impeding displacement of the wellbore coupler displacement-opposing member 402 relative to the engagement member 302, while the release of the wellbore coupler 304, from retention relative to the wellbore feature 502, is being opposed by the wellbore coupler displacement-opposing member 402. Such impeding delays release of the wellbore coupler 304 from the wellbore feature 502, such as the locate profile 502, in response to a force being applied to the wellbore coupler 304 (such as by a pulling up force) such that an operator, at the surface, is provided sufficient time to observe and identify an indication that the wellbore coupler 304 has become retained relative to the wellbore feature 502, such as the locate profile 502 (e.g. an increase in force required to displace the wellbore coupler 304 relative to the locate profile 502).

In some embodiments, for example, the displacement impeder 600 includes a housing 601 that is threaded onto a downhole end of the conveyance member 201.

In some embodiments, for example, the impeding of the displacement of the locator displacement-opposing member 402, relative to the engagement member 302, is effected by fluid flow resistance. In this respect, the release of the engagement member 302 from retention by the locate profile, while the locator displacement-opposing member 402 is being displaced relative to the engagement member 302, is delayed by opposition to fluid flow urged by such displacement. In some embodiments, for example, the displacement impeder 600 is a dashpot. It is also understood that the impeding could be effected by mechanical resistance, such as that effectuated by a biasing member, such as a spring. Exemplary embodiments where the impeding is effected by mechanical resistance are described in International Application No. PCT/CA2016/000278.

In this respect, in some embodiments, for example, and referring to FIGS. 1 to 19G, the displacement impeder 600 further includes a housing 601 that contains fluid 630, such as, for example, hydraulic fluid. The fluid 630 is contained within a fluid conductor 602, defined within the housing 601. The wellbore coupler 304, the locator displacement-opposing member 402, the fluid conductor 602 and the fluid 630 are co-operatively configured such that while:

the wellbore coupler 304 is releasably retained within the locate profile 502 (i.e. the engagement member 302 is disposed in an extended position within the locate profile 502);

displacement of the wellbore coupler 304 to the retracted position (i.e. displacement of the engagement member 302 from the extended position (such as, for example, from disposition within the locate profile 502) to the retracted position) is being opposed (for example, prevented, impeded, or otherwise opposed) by the locator displacement-opposing member 402; and the locator displacement-opposing member 402 is being displaced relative to the wellbore coupler 304;

the fluid conductor is being displaced relative to the fluid, with effect that the fluid is effecting resistance to the displacement of the locator displacement-opposing member 402 relative to the wellbore coupler 304.

The displacement of the fluid 630 includes conduction of the fluid 630 through the fluid conductor 602 for effecting the impeding of the displacement of the locator displacement-opposing member 402 relative to the engagement member 302 while such displacement is being urged. In some embodiments, for example, the impeding of the displacement is attributable to resistance to fluid flow that is imparted by the fluid conductor 602 while the fluid 630 is being conducted through the fluid conductor 602.

In some embodiments, for example, the fluid conductor 602 includes a flow restrictor 610.

In some embodiments, for example, the fluid conductor 602 includes a valve member 622 disposed in fluid communication with the fluid 630 and configured for opening in response to pressure of the fluid 630 exceeding a predetermined minimum pressure, wherein the fluid 630 is disposed in force transmission communication with the engagement member 302 such that the force urging the displacement of the locator displacement-opposing member 402 relative to the engagement member 302 (for effecting the change in condition of the engagement member 302, such as, for example, the unseating of the protuberance 302A) is transmitted to the fluid 630 to effect an increase in pressure of the fluid 630, wherein the exceeding of a predetermined minimum pressure corresponds to the application of a force that is at or above the predetermined minimum force. In this respect, the valve member 622 functions as a pressure relief device.

In some embodiments, for example, the engagement member 302, the fluid conductor 602, the fluid 630 and the locator displacement-opposing member 402 are co-operatively configured such that:

(i) relative displacement between the locator displacement-opposing member 402 and the engagement member 302 is effected for effecting the change in condition of the engagement member 302 such that opposition to displacement of the engagement member 302, relative to the locate profile 502, from the extended position (such as, for example, from disposition within the locate profile 502) to the retracted position, by the locator displacement-opposing member 402, is defeated or substantially defeated;

(ii) displacement of the fluid through the fluid conductor 602 is effected, with effect that the displacement of the locator displacement-opposing member 402 relative to the engagement member 302 is impeded;

in response to application of a displacement-urging force (e.g. uphole pulling force on the conveyance member 201), that is urging the relative displacement between the locator displacement-opposing member 402 and the engagement member 302 for effecting the change in condition of the engagement member 302 such that opposition to displacement of the engagement member 302, relative to the locate profile 502, from the extended position (such as, for example, from disposition within the locate profile 502) to the retracted position, by the locator displacement-opposing member 402, is defeated or substantially defeated, while:

the engagement member 302 is disposed in an extended position within the locate profile 502 such that the wellbore coupler 304 is releasably retained relative to the locate profile 502; and the locator displacement-opposing member 402 is opposing (e.g. preventing or impeding), displacement of the engagement member 302, relative to the locate profile 502, from the extended position (such as, for example, from disposition within the locate profile 502) to the retracted position.

Figure 17A:
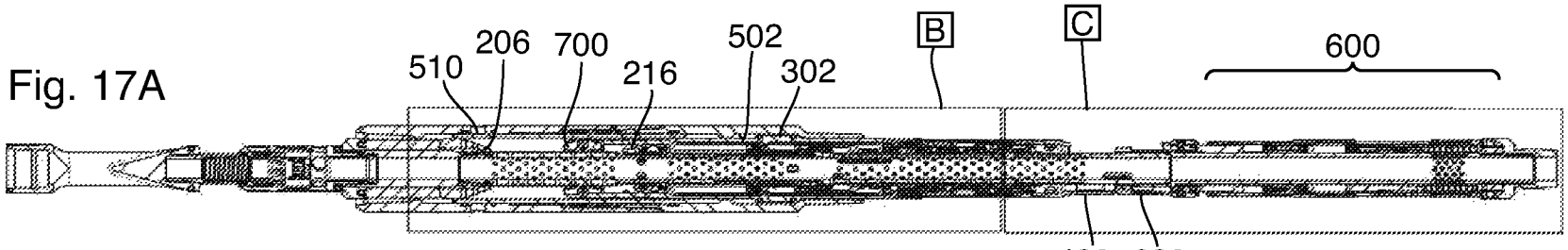
FIG. 17A is a sectional view of the shifting tool illustrated in FIG. 1, deployed within a wellbore, and disposed in a condition after having been displaced further uphole relative to the position in which it is illustrated in FIGS. 17A, 17B and 17C, and having become disposed within the next uphole locate profile and prior to the locator becoming seated on the keeper.
Figure 17B:
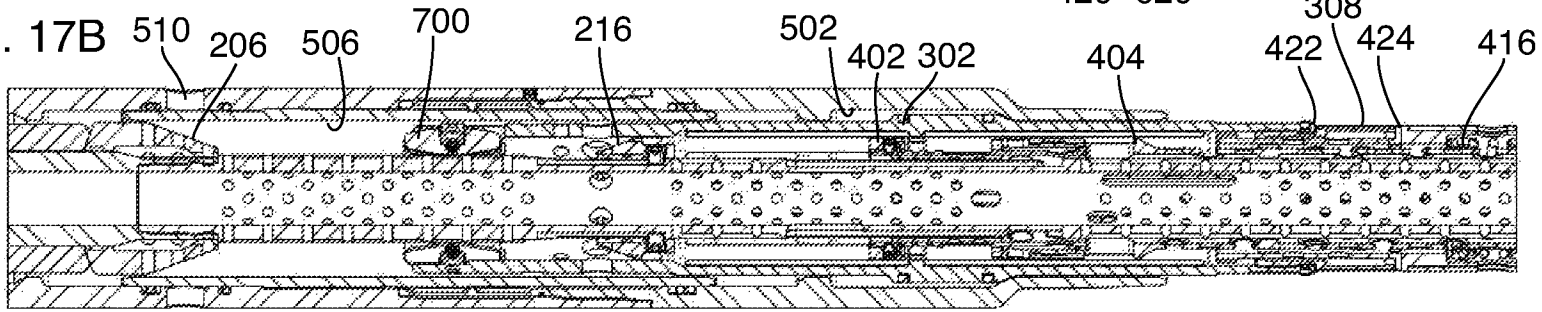
FIG. 17B is an enlarged view of Detail "B' of FIG. 17A.
Figure 17C:
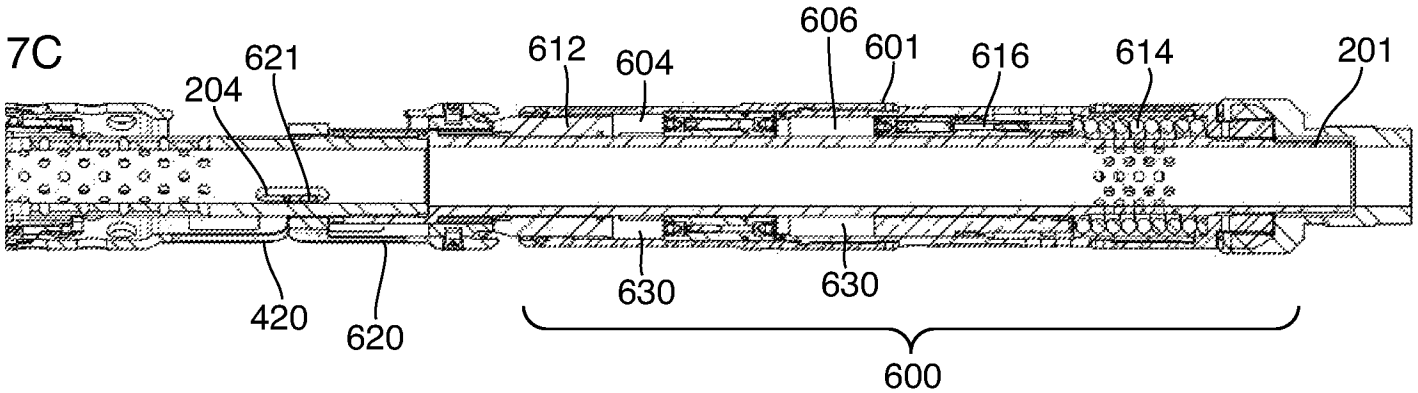
FIG. 17C is an enlarged view of Detail "C' of FIG. 17A.
Figure 18A:
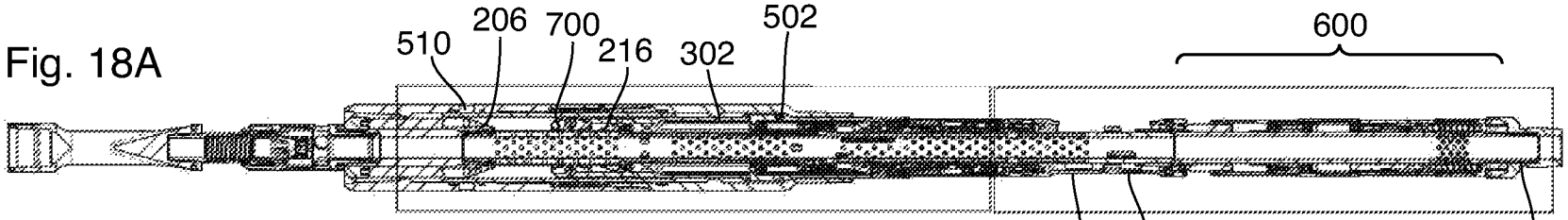
FIG. 18A is a sectional view of the shifting tool illustrated in FIG. 1, deployed within a wellbore, and disposed in a condition after having been displaced further uphole relative to the position in which it is illustrated in FIGS. 16A, 16B and 16C, and after having become disposed within the next uphole locate profile, and after the locator having become seated on the keeper and thereby resetting the displacement impeder.
Figure 18B:
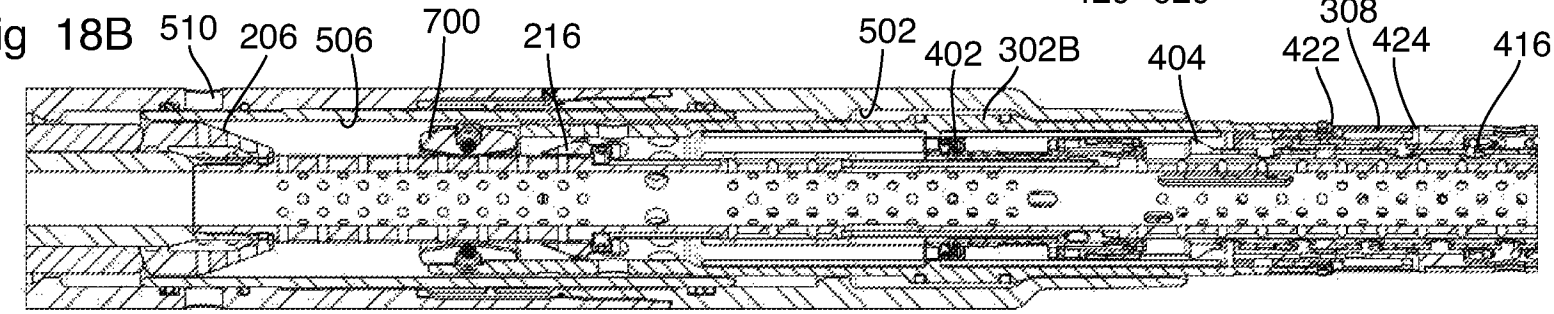
FIG. 18B is an enlarged view of Detail "B" of FIG. 18A.
Figure 18C:
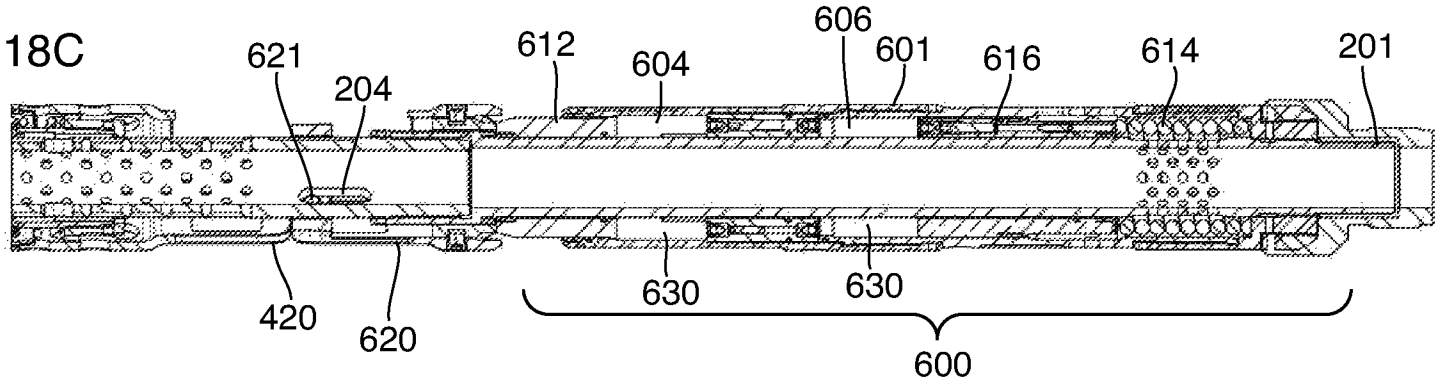
FIG. 18C is an enlarged view of Detail "C" of FIG. 18A.
Figures 19A, 19B, 19C, 19D, 19E, 19F, 19G:
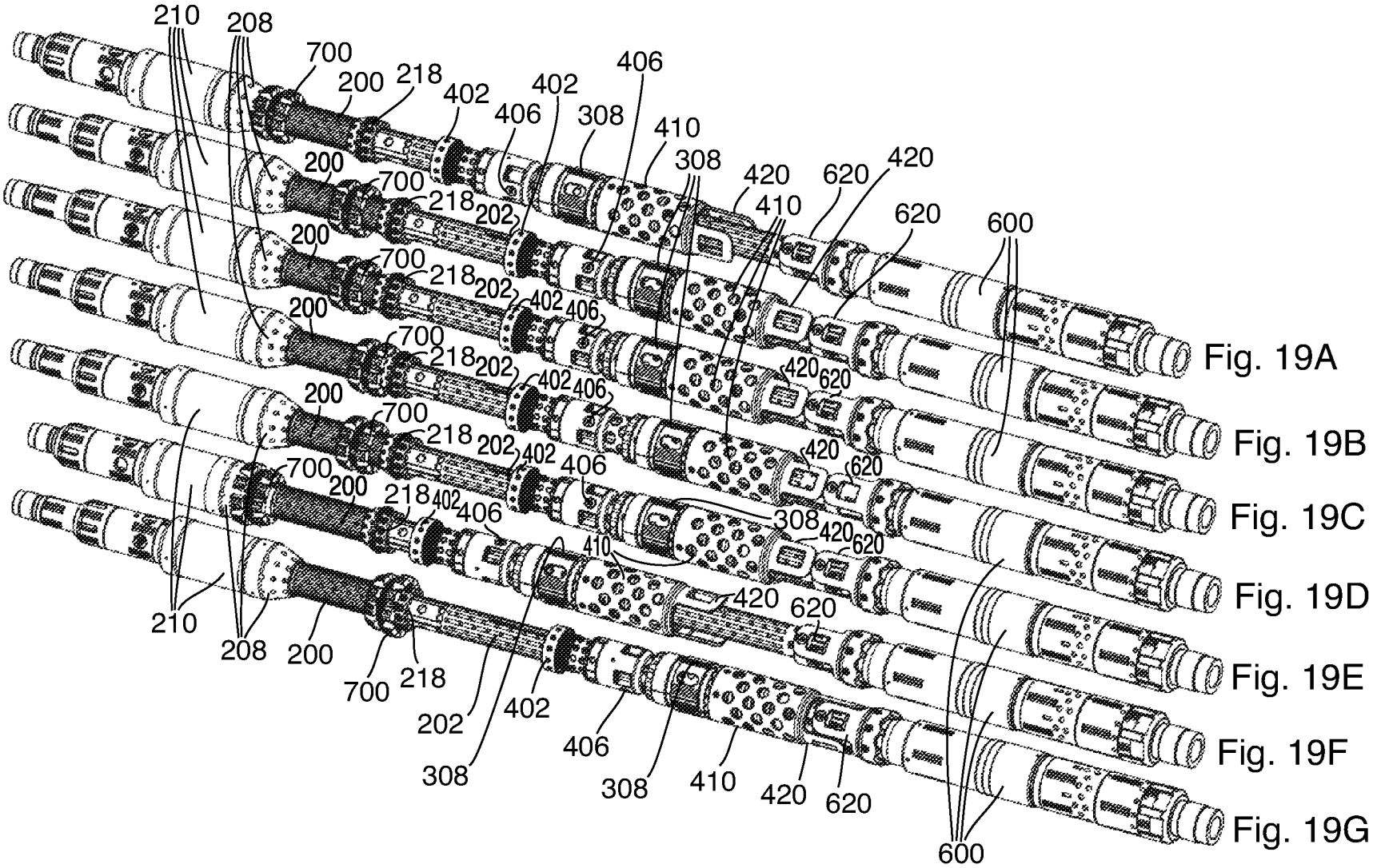
FIG. 19A is a perspective view of the shifting tool illustrated in FIG. 1, but with the collet removed for clarity, in a run-in-hole condition.
FIG. 19B is a perspective view of the shifting tool illustrated in FIG. 1, but with the collet removed for clarity, in a pull-out-of-hole condition.
FIG. 19C is a perspective view of the shifting tool illustrated in FIG. 1, but with the collet removed for clarity, in a located condition.
FIG. 19D is a perspective view of the shifting tool illustrated in FIG. 1, disposed in locate profile but with the collet having become unseated.
FIG. 19E is a perspective view of the shifting tool illustrated in FIG. 1, but with the collet removed for clarity, with displacement impeder having become reset.
FIG. 19F is a perspective view of the shifting tool illustrated in FIG. 1, but with the collet removed for clarity, in a set down condition.
FIG. 19G is a perspective view of the shifting tool illustrated in FIG. 1, but with the collet removed for clarity, in a tension set condition.
Figure 20:
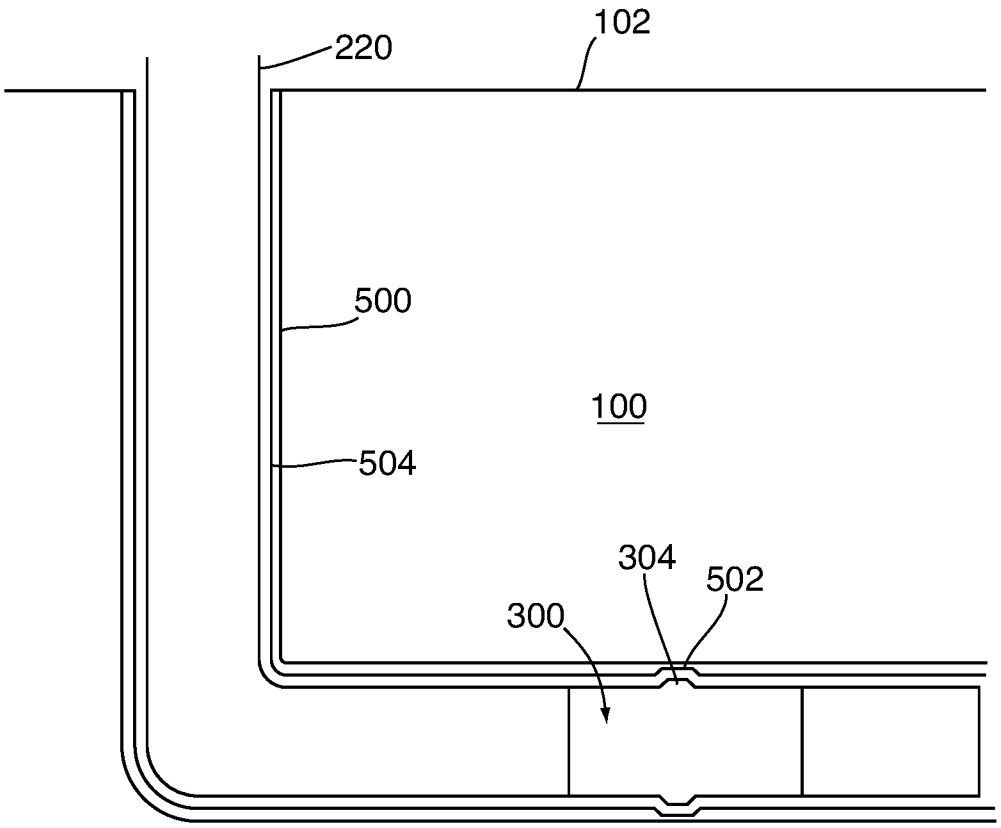
FIG. 20 is a schematic illustration of a workstring deployed within and located within a wellbore using the shifting tool of the present disclosure.

Referring to FIGS. 20A-D, in some embodiments, for example, after the engagement member 302 has become disposed in the retracted position (in some of these embodiments, for example, the engagement member 302 is disposed in an unseated condition, in some of these embodiments, for example, the engagement member 302 is disposed downhole relative to the locator displacement-opposing member 402 upon the unseating), in some of these embodiments, for example, the conveyance member 201 is pulled uphole so as to effect locating within another region of the wellbore 500, further uphole from the earlier locate (see FIGS. 17A-C). In order for the wellbore coupler 304 to become releasably retained relative to an uphole locate profile 502, while introducing a delay to its release from such releasable retention relative to the locate profile 502, the engagement member 302 is displaceable relative to the locator displacement-opposing member 402, with effect that the engagement member and the locator displacement-opposing member 402 become co-operatively disposed such that the displacement of the engagement member 302 to the retracted position is prevented or impeded by the locator displacement-opposing member 402.

In this respect, in some embodiments, for example, the functionality of re-positioning (e.g. re-seating) the engagement member 302 relative to the locator displacement-opposing member 402, such that the locator displacement-opposing member 402 is, again, opposing the release of retention of the wellbore coupler 304 relative to another locate profile 502, is combined with the functionality of impeding the displacement of the locator displacement-opposing member 402, relative to the engagement member 302, for effecting the change in condition of the engagement member 302 (such that the opposing of the release of the wellbore coupler from retention relative to the locate profile 502 is defeated), so that there is sufficient time for a positive indication of the locating of the wellbore coupler 304, effected by the preventing, or impeding, to be detected uphole.

In this respect, in some embodiments, for example, the displacement impeder 600 further includes a force transmitter 632.

The force transmitter 632 is configured to urge translation of the wellbore coupler 304 (such as, for example, by virtue of engagement to the wellbore coupler 304, or, indirectly, by virtue of engagement to the locator displacement-opposing member 402) with the conveyance member 201, during uphole displacement of the conveyance member 201 through the wellbore 500. In this respect, in some embodiments, for example, the force transmitter 632 is configured to transmit an uphole pulling force, being applied to the conveyance member 201, from the conveyance member 201 to the wellbore coupler 304. The transmission of such an uphole pulling force, while the engagement member 302 is disposed in the retracted position relative to the locate profile 502, effects displacement of the wellbore coupler 304, with the conveyance member 201, along an axis that is parallel, or substantially parallel, to the central longitudinal axis of the wellbore 500, or along an axis that is parallel, or substantially parallel, to the central longitudinal axis of the conveyance member 201, or both. As well, the transmission of such an uphole pulling force, while the engagement member 302 is disposed in the extended position (such as, for example, within the locate profile 502), and while there is an absence, or substantial absence, of opposition to displacement of the engagement member 302, relative to the locate profile 502, from the extended position (such as, for example, from disposition within the locate profile 502) to the retracted position (for example, while the engagement member 302 is unseated relative to the locator displacement-opposing member 402 and disposed within the locate profile 502), in co-operation with the configuration of the locate profile 502, urges displacement of the engagement member 302, relative to the locate profile 502, from the extended position (such as, for example, from disposition within the locate profile 502) to the retracted position, such that the wellbore coupler 304 becomes released from retention relative to the locate profile 202.

The force transmitter 632, in addition to being configured to urge translation of the wellbore coupler 304 with the conveyance member 201 during uphole displacement of the conveyance member 201 through the wellbore 500, is also configured to urge relative displacement between the wellbore coupler 304 and the locator displacement-opposing member 402, for effecting establishment of the opposing, by the locator displacement-opposing member 402, of the release of the wellbore coupler 304 from the retention relative to the locate profile 502 (for example, the establishment being effected by the seating (including re-seating) of the engagement member 302 on the locator displacement-opposing member 402).

In some embodiments, for example, the force transmitter 632 includes a first pusher 616, a second pusher 612, and the fluid 630. In this respect, with the contained fluid 630, the force transmitter 632 also enables the impeding of the displacement of the locator displacement-opposing member 402 relative to the engagement member 302 for effecting the defeating of the opposing of the engagement member 302 while the wellbore coupler 304 is releasably retained relative to the locate profile 502

In some embodiments, for example, the force transmitter 632 is disposed within the housing 601 that is mounted to the conveyance member 201.

In some embodiments, for example, the force transmitter 632 is biased by a biasing member 614 for urging the displacement of the engagement member 302 relative to the locator displacement-opposing member 402 (such as, for example, in the uphole direction, and, in some embodiments, along an axis that is parallel to the central longitudinal axis of the conveyance member 301, or along an axis that is parallel to the central longitudinal axis of the wellbore, or both). In some embodiments, for example, such urging is effected while the force transmitter 632 is engaged to the wellbore coupler 304, with effect that the engagement member 302 and the locator displacement-opposing member 402 become co-operatively disposed such that the displacement of the engagement member 302 to the retracted position is opposed, such as, for example, prevented, impeded, or otherwise opposed (for example, the urging effects seating of the wellbore coupler 304 upon the locator displacement-opposing member 402). In some embodiments, for example, such urging is effected, indirectly, via the locator displacement-opposing member 402.

In some embodiments, for example, the biasing member 614 is resilient. In some embodiments, for example, the biasing member includes a spring.

In some embodiments, for example, the biasing member 614 is retained by a biasing member retainer 348 defined within the housing 601.

The fluid conductor 602 includes a first compartment 606 and a second compartment 604, and also includes one or more displacement-impeding fluid passages 608, 618 and a return fluid passage 624.

One or more displacement-impeding fluid passages 608, 618 are provided for conducting the fluid 630 while the fluid 630 is being displaced from the second compartment 604 to the first compartment 606.

In some embodiments, for example, the one or more displacement-impeding fluid passages includes a first displacement-impeding fluid passage 618. The first displacement-impeding fluid passage 618 includes a valve member 622 configured for opening in response to pressure of the fluid 630 exceeding a predetermined minimum pressure, wherein the fluid 630 is disposed in force transmission communication with the engagement member 302 such that the force urging the relative displacement between the locator displacement-opposing member 402 and the engagement member 302 (for effecting the change in condition of the engagement member 302 such that opposition to displacement of the engagement member 302, relative to the locate profile 502, from the extended position (such as, for example, from disposition within the locate profile 502) to the retracted position, by the locator displacement-opposing member 402, is defeated or substantially defeated) is transmitted to the fluid 630 to effect an increase in pressure of the fluid 630, wherein the exceeding of a predetermined minimum pressure corresponds to the application of a force that is at or above the predetermined minimum force.

In some embodiments, for example, the one or more displacement-impeding fluid passages includes a second displacement-impeding fluid passage 608. In some embodiments, for example, the second displacement-impeding fluid passage 608 also includes a flow restrictor 610, such as, for example, an orifice.

The second displacement-impeding fluid passage 608 is configured for conducting the fluid 630 while the fluid 630 is being displaced from the second compartment 604 to the first compartment 606, and also while the fluid 630 is being displaced from the first compartment 606 to the second compartment 604.

In some embodiments, for example, the second displacement-impeding fluid passage 608 is additional to the first displacement-impeding fluid passage 618. In some embodiments, for example, the displacement impeder 600 includes only one of the first and second displacement-impeding fluid passages 608, 618. In those embodiments where the displacement impeder 600 includes both of the fluid passages 608, 618, for example, the first displacement-impeding fluid passage 618 is provided, to complement the second displacement-impeding fluid passage 608, by providing a means for more rapidly depressurizing the first compartment 606 when the force being applied by the second pusher 612 (such as, for example, to the wellbore coupler 304), for urging retraction of the engagement member 302 from the locate profile 502, is excessive, and may result in premature retraction even while the displacement is being prevented, or impeded, by the locator displacement-opposing member 402, unless the fluid within the first compartment 606 is bled to the second compartment 604 at a faster rate than permitted via the second displacement-impeding fluid passage 608. The second displacement-impeding fluid passage 608 is independently useful in those cases where the pulling up force is relatively weak (such as when locating at relatively significant distances from the surface) and would not be sufficient to trigger opening of the valve member 622 within the first displacement-impeding fluid passage 618.

The return fluid passage 624 is provided for conducting the fluid 630 while the fluid 630 is being displaced from the first compartment 606 to the second compartment 604. The return fluid passage 624 includes a one-way valve 358 for preventing, or substantially preventing, conduction of the fluid 630 from the second compartment 604 to the first compartment 606 via the return fluid passage 624. By providing the one-way valve 358, the return fluid passage 624 is not functional for conducting fluid being displaced from the second compartment 604 to the first compartment 606, which would otherwise detract from the impeding of such fluid conduction that is imparted by the one or more displacement-impeding fluid passages while the relative displacement between the engagement member 302 and the locator displacement-opposing member 402 is being effected to effect the change in condition of the engagement member 302 such that opposition to displacement of the engagement member 302, relative to the locate profile 502, from the extended position (such as, for example, from disposition within the locate profile 502) to the retracted position, by the locator displacement-opposing member 402, is defeated or substantially defeated.

In those embodiments where the second displacement-impeding fluid passage 608 is provided, in some of these embodiments, for example, the resistance to fluid flow, that the second displacement-impeding fluid passage 608 is configured to provide while conducting the fluid from the second compartment 604 to the first compartment 606, is greater than the resistance to fluid flow, that the return fluid passage 624 is configured to provide while conducting the fluid from the first compartment 606 to the second compartment 604, such as, for example, by a multiple of at least 1.1, such as, for example, by a multiple of at least 2. In some embodiments, for example, the minimum cross-sectional flow area of the return fluid passage 624 is greater than the minimum cross-sectional flow area of the second displacement-impeding passage 356, such as, for example, by a multiple of at least 1.1, such as, for example, by a multiple of at least 2. The resistance to fluid flow that the return fluid passage 624 is to provide is, in some embodiments, for example, less than that of the second displacement-impeding fluid passage 608. Otherwise, the rate at which fluid is being conducted from the first compartment 606 to the second compartment 604 may be insufficient in some embodiments for reliably effecting relative displacement between the engagement member 302 and the locator displacement-opposing member 402, for effecting the co-operative disposition of the engagement member 302 and the locator displacement-opposing member 402 such that the displacement of the engagement member 302, relative to the locate profile 502, from the extended position (such as, for example, from disposition within the locate profile 502) to the retracted position is opposed (e.g. prevented or impeded) by the locator displacement-opposing member 402.

The fluid 630 is disposed within the fluid conductor 602 and configured for:

(i) being displaced from the second compartment 606 to the first compartment 604 in response to application of a displacement-urging force (e.g. uphole pulling force on the conveyance member 201), that is urging the relative displacement between the locator displacement-opposing member 402 and the engagement member 302 for effecting the change in condition of the engagement member 302 such that opposition to displacement of the engagement member 302, relative to the locate profile 502, from the extended position (such as, for example, from disposition within the locate profile 502) to the retracted position, by the locator displacement-opposing member 402, is defeated or substantially defeated, while:

the engagement member 302 is disposed in an extended position within the locate profile 502 such that the wellbore coupler 304 is releasably retained relative to the locate profile 502; and the locator displacement-opposing member 402 is opposing (e.g. preventing or impeding), displacement of the engagement member 302, relative to the locate profile 502, from the extended position (such as, for example, from disposition within the locate profile 502) to the retracted position.

(ii) being displaced from the first compartment 604 to the second compartment 606 in response to the urging of the biasing member 614.

The second pusher 612 is provided for transmitting a displacement-urging force (e.g. the force being applied to the workstring while the workstring is being pulled uphole, see below) to the wellbore coupler 304 for urging displacement of the wellbore coupler 304 (e.g. uphole through the wellbore 500, and, in some embodiments, along an axis that is parallel to the central longitudinal axis of the conveyance member 201, or along an axis that is parallel to the central longitudinal axis of the wellbore, or both). In some embodiments, for example, the second pusher 612 is configured for becoming disposed in engagement with the wellbore coupler 304 for transmitting the displacement-urging force.

In some embodiments, for example, the second pusher 612 is also provided for becoming disposed relative to the wellbore coupler 304 and the locator displacement-opposing member 402 (such as, for example, engaged to the wellbore coupler 304) while the wellbore coupler 304 is releasably retained relative to the locate profile 502, for urging conduction of the fluid 630 through the fluid conductor 602 in response to the relative displacement, between the wellbore coupler 304 and the locator displacement-opposing member 402 (for effecting the change in condition of the engagement member 302 such that opposition to displacement of the engagement member 302, relative to the locate profile, from the extended position (such as, for example, from disposition within the locate profile 502) to the retracted position, by the locator displacement-opposing member 402, is defeated or substantially defeated.), for effecting impeding of such relative displacement.

The second pusher 612 is also provided for transmitting the biasing force received from the biasing member 614, via at least the first pusher 616 and the fluid 630.

The first pusher 616 is coupled (e.g. connected) to the biasing member 614 such that the biasing of the force transmitter 632 by the biasing member 614 is effected by the coupling of the first pusher 616 to the biasing member 614. In this respect, the first pusher 616 is disposed for effecting force transmission communication between the biasing member 614 and the fluid 630.

The fluid 630 is disposed, relative to the first and second pushers 616, 612 for effecting force transmission communication between the first and second pushers 616, 612. In some embodiments, for example, the fluid is disposed between the first and second pushers 616, 612, and, in this respect, the first pusher 616 is disposed between the fluid 630 and the biasing member 614.

In some of these embodiments, for example, the engagement member 302, the first pusher 616, the first compartment 606, the fluid 630, the second compartment 604, the second pusher 612, the first and second displacement-impeding fluid passages 354, 356, the return fluid passage 624, and the biasing member 614 are co-operatively configured such that:

the second pusher 612 is displaced within the second compartment 604 (for example, in a downhole direction) with effect that the volume of the space within the second compartment 604, that is available for occupation by the fluid 630, decreases;

displacement of the fluid 630 from the second compartment 606 to the first compartment 604 is urged (via at least one of the first and second displacement-impeding fluid passages 354, 356) with effect that the relative displacement, between the engagement member 302 and the locator displacement-opposing member 402, for effecting a change in condition of the engagement member 302 such that opposition to displacement of the engagement member, relative to the locate profile 502, from the extended position (such as, for example, from disposition within the locate profile 502) to the retracted position, by the locator displacement-opposing member 402, is defeated or substantially defeated, is impeded;

the first pusher 616 is displaced within the first compartment 606, with effect that the volume of the space within the first compartment 606, that is available for occupation by the fluid 630, increases; and compression of the biasing member 614 is being effected such that absorption of energy by the biasing member 614 is effected;

while:

the wellbore coupler 304 is releasably retained within the locate profile 502 (i.e. the engagement member 302 is disposed in an extended position within the locate profile 502);

displacement of the wellbore coupler 304 to the retracted position (i.e. displacement of the engagement member 302 from the extended position (such as, for example, from disposition within the locate profile 502) to the retracted position) is being opposed (for example, prevented, impeded, or otherwise opposed) by the locator displacement-opposing member 402; and the locator displacement-opposing member 402 is being displaced relative to the wellbore coupler 304.

In some embodiments, for example, where the wellbore coupler 304 includes the protuberance 302A, after the defeating of the opposing (for example, resulting in the engagement member 302 becoming unseated relative to the wellbore coupler displacement-opposing member 402), a pulling up force applied to the conveyance member 201, in combination with the configuration of the locate profile 502 (see above), effects the displacement of the engagement member 302, relative to the locate profile 502, from the extended position (such as, for example, from disposition within the locate profile 502) to the retracted position, such that the wellbore coupler 304 becomes released from retention relative to the locate profile 502 and the protuberance 302A becomes disposed adjacent to and downhole relative to the wellbore coupler displacement-opposing member 402. This results in the wellbore coupler 304 being prevented from being displaced uphole, relative to the wellbore coupler displacement-opposing member 402 for effecting the seating (or re-seating) of the wellbore coupler 304 on the wellbore coupler displacement-opposing member 402, such uphole displacement being urged by the biasing member 614 via the force transmitter 632. Because the collet springs 304 have collapsed, and the conveyance member 201 has moved further uphole such that the engagement member 302 is no longer in alignment with the locate profile 502, the biasing force of the collet springs 304, urging outwardly displacement of the engagement member 302, is opposed by the wellbore string such that the engagement member 302 is prevented by the wellbore string from becoming outwardly displaced relative to the conveyance member 201, and such that disposition of the protuberance 302A against the wellbore coupler displacement-opposing member 402, urged by the biasing member 614, is maintained.

In this respect, in some embodiments, for example, the wellbore coupler displacement-opposing member 402 includes a retainer surface 402A. In some embodiments, for example, the retainer surface 402A includes a normal axis that is transverse (such as, for example, orthogonal, or substantially orthogonal) to the normal axis of the seating surface 402B (that is configured for receiving seating of the protuberance 302A of the wellbore coupler 304 while the engagement member 302 is disposed in the extended condition and within the locate profile 502) of the wellbore coupler displacement-opposing member 402. The conveying member 201, the wellbore coupler displacement-opposing member 402, the engagement member 302, the force transmitter 632, and the biasing member 614 are co-operatively configured such that:

displacement of the engagement member 302, relative to the locate profile 502, from the extended position (such as, for example, from disposition within the locate profile 502) to the retracted position, is effected;

in response to the urging of a displacement urging force being applied (for example, in an uphole direction) to the conveyance member 201 (and transmitted by the force transmitter 632), while the protuberance 302A of the wellbore coupler 304 is unseated relative to the wellbore coupler displacement-opposing member 402 and disposed within the locate profile 502 that is configured to co-operate with the urging of the displacement urging force for encouraging the displacement of the engagement member 302 to the retracted position;

and the protuberance 302A of the wellbore coupler 304 becomes disposed, relative to the retainer surface 402A of the wellbore coupler displacement-opposing member 402, such that the retainer surface 402A prevents, or substantially prevents, displacement of the engagement member 302, relative to the wellbore coupler displacement-opposing member 402, (such as, for example, in an uphole direction, such as, for example, along an axis that is parallel, or substantially parallel, to the central longitudinal axis of the conveyance member 201, along an axis that is parallel, or substantially parallel, to the central longitudinal axis of the wellbore 102, or both) being urged by the biasing member 614 via the force transmitter 632, in response to a displacement of the conveying member 201 (such as in an uphole direction relative to the locate profile 502), relative to the locate profile 502, such that the engagement member 302 becomes aligned with an opposing surface of the wellbore 500 that is insufficiently spaced outwardly relative to the engagement member 302 such that there is insufficient clearance for receiving sufficient displacement of the engagement member 302, relative to the wellbore coupler displacement-opposing member 402, to clear the retainer surface 402A, while the biasing member 614 continues to urge displacement of the wellbore coupler 304 relative to the wellbore coupler displacement-opposing member 402 (such as, for example, in the uphole direction, and, in some embodiments, along an axis that is parallel to the central longitudinal axis of the conveyance member 301, or along an axis that is parallel to the central longitudinal axis of the wellbore, or both).

While the protuberance 302A is disposed, relative to the retainer surface 402A of the wellbore coupler displacement-opposing member 402, such that the retainer surface 402A opposes displacement of the protuberance 302A (and, therefore, the wellbore coupler 304), relative to the wellbore coupler displacement-opposing member 402, being urged by the biasing member 614 via the force transmitter 632, an uphole pulling force applied to the conveyance member 201 effects displacement of the conveyance member 201 in an uphole direction, and displacement of the wellbore coupler 304 is also effected in an uphole direction, in concert with the uphole displacement of the conveyance member 201.

Upon the engagement member 302 becoming disposed in alignment with another locate profile 502, the engagement member 302, owing to the bias exerted by the collet springs 304 in their compressed state, is displaced to the extended position, clearing the retainer surface 402A, and becoming disposed within the locate profile 502. In this respect, the wellbore coupler displacement-opposing member 402, the engagement member 302, the force transmitter 632, and the biasing member 614 are co-operatively configured such that:

displacement of the engagement member 302 to disposition in an extended position, such as, for example, within the locate profile 502 (such as, for example, in an outwardly direction relative to the central longitudinal axis of the conveyance member 201, or relative to the central longitudinal axis of the wellbore 102, or both) is effected such that the engagement member 302 becomes displaceable relative to the wellbore coupler displacement-opposing member 402 (such as, for example, along an axis that is parallel, or substantially parallel, to the central longitudinal axis of the conveyance member 201, along an axis that is parallel, or substantially parallel, to the central longitudinal axis of the wellbore 102, or both) by the biasing member 614 via the force transmitter 632;

in response to the removal of opposition (such as, for example, alignment with another locate profile 302) to the displacement of the engagement member 302 (such as, for example, in an outwardly direction relative to the central longitudinal axis of the conveyance member 201, or in an outwardly direction relative to the central longitudinal axis of the wellbore 102, or both) relative to the wellbore coupler displacement-opposing member 402 for effecting clearance of the retainer surface 402A by the engagement member 302 (for example, the relative displacement is for the engagement member 302 becoming disposed within the locate profile 502), while the protuberance 302A is disposed, relative to the retainer surface 402A of the wellbore coupler displacement-opposing member 402, such that the retainer surface 402A prevents displacement of the engagement member 302, relative to the wellbore coupler displacement-opposing member 402 (such as, for example, displacement along an axis that is parallel, or substantially parallel, to the central longitudinal axis of the conveyance member 201, or along an axis that is parallel, or substantially parallel, to the central longitudinal axis of the wellbore 102, or both) being urged by the biasing member 614 via the force transmitter 632.

Upon the clearing of the retainer surface 402A by the engagement member 302 and disposition of the engagement member 302 within the locate profile 502, because of the urging of the biasing member 614, via the force transmitter 632, the wellbore coupler 304 is displaced relative to the wellbore coupler displacement-opposing member 402 (such as, for example, displacement along an axis that is parallel, or substantially parallel, to the central longitudinal axis of the conveyance member 201, or along an axis that is parallel, or substantially parallel, to the central longitudinal axis of the wellbore 102, or both) such that the protuberance 302A becomes seated on the wellbore coupler displacement-opposing member 402. In this respect, the wellbore coupler displacement-opposing member 402, the engagement member 302, the force transmitter 632, and the biasing member 614 are co-operatively configured such that:

displacement of the engagement member 302, relative to the wellbore coupler displacement-opposing member 402, is effected by the biasing member 614 via the force transmitter 632, such that the protuberance 302A becomes seated on the wellbore coupler displacement-opposing member 402;

in response to urging of the displacement of the engagement member, relative to the wellbore coupler displacement-opposing member 402, by the biasing member 614 via the force transmitter 632, while (i) the engagement member 302 is disposed in the extended position (such as, for example, within the locate profile 502) and engaged to the second pusher 612, (ii) the engagement member 302 in unseated relative to the wellbore coupler displacement-opposing member 402, and (iii) the biasing member 614 is disposed for releasing energy for effecting the urging.

In some of these embodiments, for example, the wellbore coupler 304, the second pusher 612, the second compartment 604, the fluid 332, the first compartment 606, the first pusher 616, the one or more displacement-impeding fluid passages 608, 618, the return fluid passage 624, and the biasing member 614 are also co-operatively configured such that:

extension of the biasing member 614 is effected;

the first pusher 616 is displaced within the first compartment 606, with effect that the volume of the space within the first compartment 606, that is available for occupation by the fluid 630, decreases;

the fluid 630 is displaced from the first compartment 606 to the second compartment 604 via at least the return fluid passage 624;

the second pusher 612 is displaced within the second compartment 604, with effect that the volume of the space within the second compartment 604, that is available for occupation by the fluid 630, increases; and the wellbore coupler 304 is displaced, relative to the wellbore coupler displacement-opposing member 402, for effecting re-seating of the wellbore coupler 304 on the wellbore coupler displacement-opposing member 402 such that displacement of the engagement member 302 to the retracted position is prevented;

in response to urging of the displacement of the wellbore coupler 304, relative to the wellbore coupler displacement-opposing member 402, by the biasing member 614, while: (i) the engagement member 302 is disposed within the locate profile in the extended position and engaged to the second pusher 612, (ii) the engagement member 302 is unseated relative to the wellbore coupler displacement-opposing member 402; and (iii) the biasing member 614 is disposed for releasing energy for effecting the urging.

In some embodiments, for example, a gripper 700 is provided and is actuatable to a gripping position for gripping the wellbore string 504 (such as, for example, the casing, or a flow control member 506 of the wellbore string 504, such as a flow control member 506 in the form of a sliding sleeve) and transmitting a force being applied in one of an uphole or downhole direction. In some embodiments, for example, the gripper 700 is mounted to the wellbore coupler 304 such that the gripper 700 translates with the wellbore coupler 304. In this respect, in some embodiments, for example, the transmitted force is one being applied to the conveyance member 201 to which the wellbore coupler 304 is coupled.

In some embodiments, for example, the mounting of the gripper 700 to the wellbore coupler is effected by the disposition of the gripper 700 within slots 307A, 307B provided within the wellbore coupler 304, such disposition being supported by the conveyance member 201, over which the gripper 700 is slidably mounted. In this respect, the gripper 700 includes a collar 702 through which the conveyance member 201 extends and is movable relative to the gripper 700.

In some embodiments, for example, the actuation of the gripper 700 is such that the gripper 700 is displaced from a retracted position to the gripping position. In some embodiments, for example, the displacement is effected through the slots 307A, 307B within the wellbore coupler 304, such that the gripper 700 is disposed in the gripping position while extending through the slots 307A, 307B of the wellbore coupler 304. A retaining spring 704 is disposed within a groove 706 and biases the gripper 700 towards the retracted position. In some embodiments, for example, the displacement to the gripping position is effected by rotation of the gripper 700. In this respect, in some embodiments, for example, the gripper 700 includes a rocker 706 such that the actuation of the gripper 700 is effected by rotational displacement of the rocker 706 relative to the wellbore coupler 304.

In some embodiments, for example, the gripper 700 includes a bi-directional slip 708 which is actuatable to first and second gripping positions by rotational displacement of the rocker 706. In the first gripping position, the gripper 700 is disposed for transmitting a force being applied in one of an uphole or downhole direction. In the second gripping position, the gripper 700 is disposed for transmitting a force being applied in the other one of an uphole or downhole direction. The gripper 700 includes a first gripping surface 710 and a second gripping surface 712. Actuation of the gripper 700 to the first gripping position effects rotation of the gripper 700 such that the gripper 700 is displaced through a first slot 307A (provided within the locator 300) for extension through the slot 307A such that the first gripping surface 710 becomes disposed in gripping engagement with the wellbore string 504 (such as a wellbore feature, such as a flow control member 506 of the wellbore string 504). Actuation of the gripper 700 to the second gripping position effects rotation of the gripper 700, counter to the rotation effected by actuation of the gripper 700 to the first gripping position, such that the gripper 700 is displaced through a second slot 307B (provided within the locator 300) for extension through the slot 307B such that the second gripping surface 712 becomes disposed in gripping engagement with the wellbore feature (such as, for example, the flow control member 506).

The actuation of the gripper 700 from the retracted position to the first gripping position is effected by a first gripper actuator 206 that is translatable with the conveyance member 201. In this respect, the actuation is effected by displacement of the gripper actuator 206, and, therefore, the conveyance member 201, relative to the gripper 700. The first gripper actuator 206 includes a first setting cone 208 that is mounted over the conveyance member 201. A packer 210 is mounted over the conveyance member 201 and disposed between the first setting cone 208 and a gauge ring 212. The flow control member 506 is co-operatively disposed relative to the locate profile 502, and the first gripper actuator 206, the packer 210, and the gauge ring 212 are co-operatively disposed relative to the conveyance member 201 such that, after the locating of the shifting tool 100, and while the wellbore string 504 is resisting displacement of the wellbore coupler 304 being urged by transmission of an applied force (such as, for example, a downhole force applied to the workstring) by the conveyance member 201 such that displacement of the conveyance member 201, relative to the wellbore coupler 304, is being effected such that a first actuation stroke is defined, the first gripper actuator 206 translates with the conveyance member 201, such translation being urged by the combination of the gauge ring 212 and the packer 210, such that the setting cone 208 engages the gripper 700 and drives rotation of the gripper 700 from the retracted position to the first gripping position, thereby actuating the gripper 700 to the first gripping position such that the first gripper surface 710 is disposed in gripping engagement with the flow control member 506 (see FIGS. 8A, 8B and 8C), and such that, after the gripper 700 has become disposed in the first gripping position, compression of the packer 210 between the gauge ring 212 and the setting cone 208 is effected, resulting in sealing engagement, or substantially sealing engagement, between the packer 210 and the flow control member 506, such that a seal is created within the wellbore. Once the seal is created, the wellbore can be pressurized uphole of the seal, establishing a pressure differential across the seal, and thereby applying a force that is transmitted by the gripper 700 to the flow control member 506, thereby effecting displacement of the flow control member 506 from the closed position to an open position such that a port 510 becomes opened for effecting supplying of treatment fluid to the subterranean formation (see FIGS. 9A, 9B, and 9C).

After sufficient treatment fluid has been supplied, the flow control member 506 is displaceable to the closed position, for effecting closing of the port 510. The displacement of the flow control member 506 from the open position to the closed position is effected by the gripper 700, and, specifically, the second gripping surface 712. In order to effect such displacement, the gripper 700 is displaced to the second gripping position.

The actuation of the gripper 700 to the second gripping position is effected by a second gripper actuator 216 that is coupled to, and translates with, the conveyance member 201. In this respect, the actuation is effected by displacement of the second gripper actuator 216, and, therefore, the conveyance member 201, relative to the gripper 700. The second gripper actuator 216 includes a second setting cone 218. The second gripper actuator 216 is translatable with the conveyance member 201 such that, after the displacement of the flow control member 506 to the open position, and while the wellbore coupler 304 is releasably retained relative to the locate profile 502, transmission of an applied force (such as, for example, a tensile force being applied to the workstring in the uphole direction) by the conveyance member 201 is with effect that displacement of the conveyance member 201, relative to the wellbore coupler 304, is being effected such that a second actuation stroke of the conveyance member 201 is defined, the second gripper actuator 216 translates with the conveyance member 201 such that the setting cone 218 engages the gripper 700 and drives rotation of the gripper 700 from the first gripping position to the second gripping position, thereby actuating the gripper 700 to the second gripping position such that the second gripping surface 712 becomes disposed in gripping engagement with the flow control member 506 (see FIGS. 10A, 10B and 10C), and such that, after the gripper 700 has become disposed in the second gripping position, continued rotational displacement of the gripper 700 urges displacement of the flow control member 506 relative to the port 510 from the open position to the closed position such that the port 510 becomes closed (see FIGS. 11A, 11B and 11C).

The wellbore coupler release opposer 400 and the displacement impeder 600 are relatively positionable such that impeding of the displacement of the wellbore coupler release opposer 400, relative to the wellbore coupler 304, by the displacement impeder 600 is dependent on positioning of the wellbore coupler release opposer 400 relative to the displacement impeder 600. In this respect, in one or more positions of the wellbore coupler release opposer 400 relative to the displacement impeder 600, the impeding by the displacement impeder 600 is absent or substantially absent.

In one aspect, the wellbore coupler release opposer 400 and the displacement impeder 600 are relatively positionable such that;

while:

the wellbore coupler release opposer 400 is disposed in a first position relative to the displacement impeder 600;

the wellbore coupler 304 is releasably retained relative to the locate profile 502;

release of the wellbore coupler 304 from retention relative to the locate profile 502 is being opposed by the wellbore coupler release opposer 400;

displacing of the wellbore coupler release opposer 400, relative to the wellbore coupler 304, is being effected while the release is being opposed by the wellbore coupler release opposer 400;

the displacing of the wellbore coupler release opposer 400, relative to the wellbore coupler 304, while the release is being opposed by the wellbore coupler release opposer 400, is impeded by the displacement impeder 600;

and while:

the wellbore coupler release opposer 400 is disposed in a second position relative to the displacement impeder 600;

the wellbore coupler is releasably retained relative to the locate profile 502; and release of the wellbore coupler 304 from retention relative to the locate profile 502 is being opposed by the wellbore coupler release opposer 400;

displacing of the wellbore coupler release opposer 400, relative to the wellbore coupler 304, is being effected while the release is being opposed by the wellbore coupler release opposer 400;

impeding of the displacing of the wellbore coupler release opposer 400, relative to the wellbore coupler 304, by the displacement impeder 600, while the release is being opposed by the wellbore coupler release opposer 400, is prevented or substantially prevented.

In another aspect, the wellbore coupler release opposer 400 and the displacement impeder 600 are relatively positionable such that:

while:

the wellbore coupler release opposer 400 is disposed in a first position relative to the displacement impeder 600;

the wellbore coupler 304 (and, therefore, the engagement member 302) is disposed in the extended position; and displacement of the wellbore coupler 304 (and, therefore, the engagement member 302) from the extended position to the retracted position is being opposed by the wellbore coupler displacement-opposing member 402; and displacing of the wellbore coupler displacement-opposing member 402, relative to the wellbore coupler 304, is being effected while the release is being opposed by the wellbore coupler release opposer 400;

the displacing of the wellbore coupler displacement-opposing member 402, relative to the wellbore coupler 304, while the release is being opposed by the wellbore coupler release opposer 400, is impeded by the displacement impeder 600;

and while:

the wellbore coupler release opposer 400 is disposed in a second position relative to the displacement impeder 600;

the wellbore coupler 304 (and, therefore, the engagement member 302) is disposed in the extended position; and displacement of the wellbore coupler 304 (and, therefore, the engagement member 302) from the extended position to the retracted position is being opposed by the wellbore coupler displacement-opposing member 402; and displacing of the wellbore coupler displacement-opposing member 402, relative to the wellbore coupler 304, is being effected while the release is being opposed by the wellbore coupler release opposer 400;

impeding of the displacing of the wellbore coupler displacement-opposing member 402, relative to the wellbore coupler 304, by the displacement impeder 600, while the release is being opposed by the wellbore coupler release opposer 400, is prevented or substantially prevented.

In some embodiments, for example, the force transmitter 632 is coupled to the housing 601 with a frangible member, such as a shearout ring 660 (see FIG. 1). In this respect, if the force transmitter 632 becomes inoperable such that operation of the shifting tool 100 becomes compromised, application of an uphole pulling force that exceeds a minimum predetermined force effects shearing of the shearout ring 660, thereby enabling recovery of the remainder of the shifting tool 100.

In this respect, in some embodiments, for example, the wellbore coupler release opposer 400 includes a rotatable mandrel 404 having a j-pin 406 extending therefrom and received within the j-slot 202 for travel through the j-slot 202. In this respect, the rotatable mandrel 404 is coupled to the conveyance member 201 via a j-tool (defined by the combination of the j-pin 406 and the j-slot) for translation with conveyance member 201 along a longitudinal axis of the conveyance member 201. The rotatable mandrel 404 is coupled at a first end 404A, via a collar 408, to the wellbore coupler displacement-opposing member 402 for rotation, relative to the wellbore coupler displacement-opposing member 402, about the longitudinal axis of the rotatable mandrel 408 (and, in some embodiments, also about the longitudinal axis of the conveyance member 201). In this respect, the coupling is such that the wellbore coupler displacement-opposing member 402 is rotationally independent of the rotatable mandrel 404.

The rotatable mandrel 404 extends into, and is coupled to a force transmission member 410 for limited displacement, relative to the force transmission member 410, along a longitudinal axis of the rotatable member 404. When disposed in some positions relative to the force transmission member 410, the rotatable mandrel 404 is translatable with the force transmission member 410 along a longitudinal axis of the rotatable mandrel 404. The force transmission member 410 includes two parts 410A, 410B that are fixed to one another by alignment pins 411. Providing force transmission member 410 in two parts facilitates assembly of the wellbore coupler release opposer 400.

A plurality of spaced-apart circumferentially disposed alignment pins 412 extend outwardly from the rotatable mandrel 404 and through slots 414 provided in the force transmission member. When a downhole force is applied to the rotatable mandrel 404 (such as a downhole force transmitted by the conveyance member 201 to the rotatable mandrel 404 via the j-tool), the pins 412 shoulder against downhole ends of the slots 414, urging downhole displacement of the force transmission member 410.

As well, the rotatable mandrel 404 is coupled to the force transmission member 410 via a resilient member 416 (such as, for example, a compression spring) that is biasing the rotatable mandrel 404 towards a downhole end of the force transmission member 414, such that the pins 412 are urged towards the downhole ends of the slots 414. In this respect, a nut 417 (e.g. spring nut) is threaded onto a second opposite end 404B of the rotatable mandrel 404, and an internal surface 418 of the force transmission member 410 defines a mounting surface, such that the resilient member 416 is mounted between the nut 417 and the mounting surface of the force transmission member 410.

As the conveyance member 201 is being displaced uphole (such as, for example, by a pulling force), the rotatable mandrel 404 translates with the conveyance member 201 by virtue of coupling via the j-tool (i.e. the coupling between the j-pin 406 and the j-slot 202), and, in turn, the force transmission member 410 translates with the rotatable mandrel 404, as the resilient member 414 is compressed in response to the uphole displacement of the nut 416, unless the uphole displacement of the force transmission member 410 is being opposed, such as by the wellbore coupler 304 (see below), in which case, the rotatable mandrel 404 displaces uphole independently of the force transmission member 410, such independent displacement being facilitated by the slots 414 which receive uphole travel of the alignment pins 412.

The coupling of the rotatable mandrel 404 to the force transmission member 410 is also with effect that the force transmission member is rotatable with the rotatable mandrel 404. In this respect, as the j-pin 406 is travelling through the j-slot 202, in response to alternating uphole and downhole strokes of the conveyance member 201, the rotatable mandrel 404 rotates about the longitudinal axis of the conveyance member 201. In turn, by virtue of the rotatable coupling of rotatable mandrel 404 to the force transmission member 410 via extension of the pins 412 through the slots 414, the force transmission member 410 rotates with the rotatable mandrel 404, such that the force transmission member 410 rotates relative to the longitudinal axis of the conveyance member 201.

At a downhole end, the force transmission member 410 includes an upper castellation 420 configured for engaging a lower castellation 620. The lower castellation 620 is retained relative to the conveyance member 201, via disposition of a pin 621 of the lower castellation 620 within a slot 204 of the conveyance member 201, such that displacement of the lower castellation 620 relative to the conveyance member 201 is effectible for engaging the force transmitter 632 (specifically, the second pusher 612) while the wellbore coupler 304 is being releasably retained relative to the locate profile 502 (i.e. the engagement member 302 is disposed in an extended position within the locate profile 502), the wellbore coupler displacement-opposing member 402 is opposing the retraction of the wellbore coupler 304 relative to the locate profile, and relative displacement between the wellbore coupler displacement-opposing member 402 and the wellbore coupler 304 is being effected. Under these circumstances, the engaging of the lower castellation 620 with the force transmitter 632 (and, specifically, with the second pusher 612) is with effect that displacement of the fluid conductor 602, relative to the fluid 630, is effected in response to the displacement of the wellbore coupler displacement-opposing member 402 relative to the wellbore coupler 304, with effect that resistance to the displacement of the locator displacement-opposing member 402 relative to the wellbore coupler 304 (i.e. the displacement of the locator displacement-opposing member 402 relative to the wellbore coupler 304 is impeded).

By virtue of its coupling to the rotatable mandrel 404 (which is coupled to the conveyance member 201, via the j-tool, for rotation relative to the conveyance member 201 about a longitudinal axis of the conveyance member 201), the force transmission member 410 is rotatable relative to the displacement impeder 600 about a longitudinal axis of the conveyance member 201, and, in this respect, the upper castellation 420 is rotatable relative to the lower castellation about a longitudinal axis of the conveyance member 201. Depending on the position of the upper castellation 420 relative to the lower castellation 620, which is determined by the position of the j-pin 406 within the j-slot 202, the above-described impeding of the displacement of the wellbore coupler release opposer 400, relative to the wellbore coupler 304, can be effected by the displacement impeder 600. As well, depending on the position of the upper castellation 420 relative to the lower castellation 620, which is determined by the position of the j-pin 406 within the j-slot 202, the above-described impeding of the displacement of the wellbore coupler displacement-opposing member 402, relative to the wellbore coupler 304, by the displacement impeder 600, can be prevented.

In this respect, while projections of the upper castellation 420 are aligned with the projections of the lower castellation 620 during engagement of the upper castellation 420 to the lower castellation 620 (a "first orientation"), the above-described impeding of the displacement of the wellbore coupler release opposer 400, relative to the wellbore coupler 304, is effected by the displacement impeder 600, while the wellbore coupler 304 is being releasably retained relative to the locate profile 502 (i.e. the engagement member 302 is disposed in an extended position within the locate profile 502), the wellbore coupler displacement-opposing member 402 is opposing the retraction of the wellbore coupler 304 relative to the locate profile, and displacement of the wellbore coupler displacement-opposing member 402 is being effected relative to the wellbore coupler 304.

Conversely, while the upper castellation 420 is nested within the lower castellation 620 (a "second orientation"), the above-described impeding of the displacement of the wellbore coupler release opposer 400, relative to the wellbore coupler 304, by the displacement impeder 600, is prevented.

While the wellbore coupler 304 is being releasably retained relative to the locate profile 502 (i.e. the engagement member 302 is disposed in an extended position within the locate profile 502), the wellbore coupler displacement-opposing member 402 is opposing the retraction of the wellbore coupler 304 relative to the locate profile, and relative displacement between the wellbore coupler displacement-opposing member 402 and the wellbore coupler 304 is being effected, the impeding of the displacement of the wellbore coupler release opposer 400, relative to the wellbore coupler 304, by the displacement impeder 600 is effected while the upper and lower castellations 420, 620 are co-operatively disposed in the first orientation, but not while the upper and lower castellations 420, 620 are co-operatively disposed in the second orientation. This is because, in the first orientation, the upper and lower castellations 420, 620 becomes engaged to one another further uphole versus the second orientation.

As a result, while:

the upper and lower castellations 420, 620 are co-operatively disposed in the second orientation;

the wellbore coupler 304 is being releasably retained relative to the locate profile 502 (i.e. the engagement member 302 is disposed in an extended position within the locate profile 502);

the releasable retention of the wellbore coupler 304, relative to the locate profile 502, is preventing uphole displacement of the upper castellation 420;

the wellbore coupler displacement-opposing member 402 is opposing the retraction of the wellbore coupler 304 relative to the locate profile 502; and displacement of the wellbore coupler displacement-opposing member 402 is being effected relative to the wellbore coupler 304 in an uphole direction;

because the displacement of the wellbore coupler displacement-opposing member 402 is being effected relative to the wellbore coupler 304 in an uphole direction by the conveyance member 201 in response to an uphole pulling force being applied to the conveyance member 201, the conveyance member 201 is displaced relative to the lower castellation 601 during an uphole stroke (with consequent downhole displacement of the pin 612 within the slot 204), with effect that there is an absence of engagement of the force transmitter 632 (i.e. second pusher 612) by the lower castellation 620 during the uphole stroke, such that the displacement of the conveyance member 201 relative to the lower castellation 601 is not impeded by resistance imparted by the fluid 630 to the fluid conductor 602.

On the other hand, when the upper and lower castellations 420, 620 are co-operatively disposed in the second orientation, the engagement of the force transmitter 632 (i.e. second pusher 612) by the lower castellation 620 is effectuated further uphole relative to the second orientation, the apparatus is configured such that the engagement of the force transmitter 632 (i.e. second pusher 612) by the lower castellation 620 is effectible while upper and lower castellations 420, 620 are co-operatively disposed in the first orientation, but not the second orientation.

Figure 2:
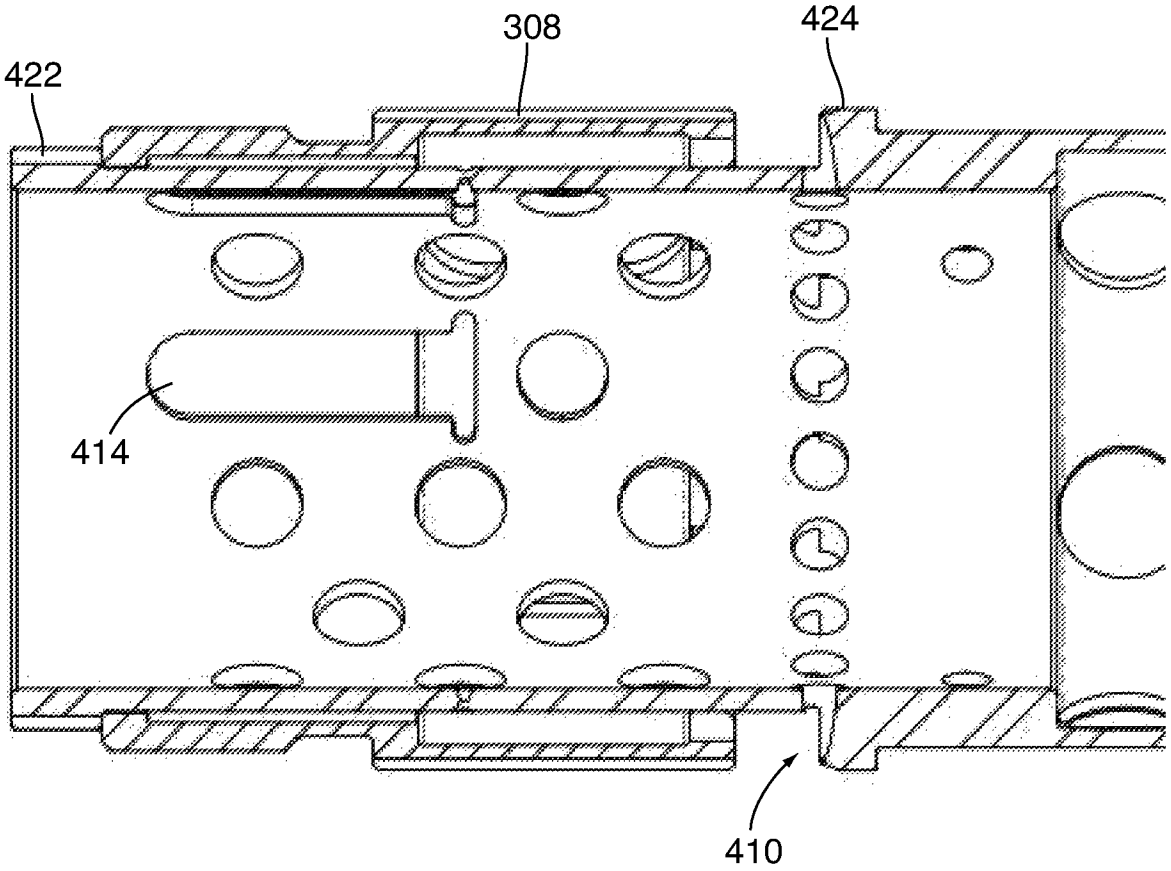
FIG. 2 is a sectional view of a portion of the shifting tool illustrated in FIG. 1, showing an uphole stop of the force transmission member urging the collar in a downhole direction, such that a force in a downhole direction is being transmitted from the mandrel via the slot, the j-pin, the rotatable mandrel 404, the uphole transmission member, and the collar to the collet, and such that the collet is translating with the mandrel in a downhole direction.
Figure 3:
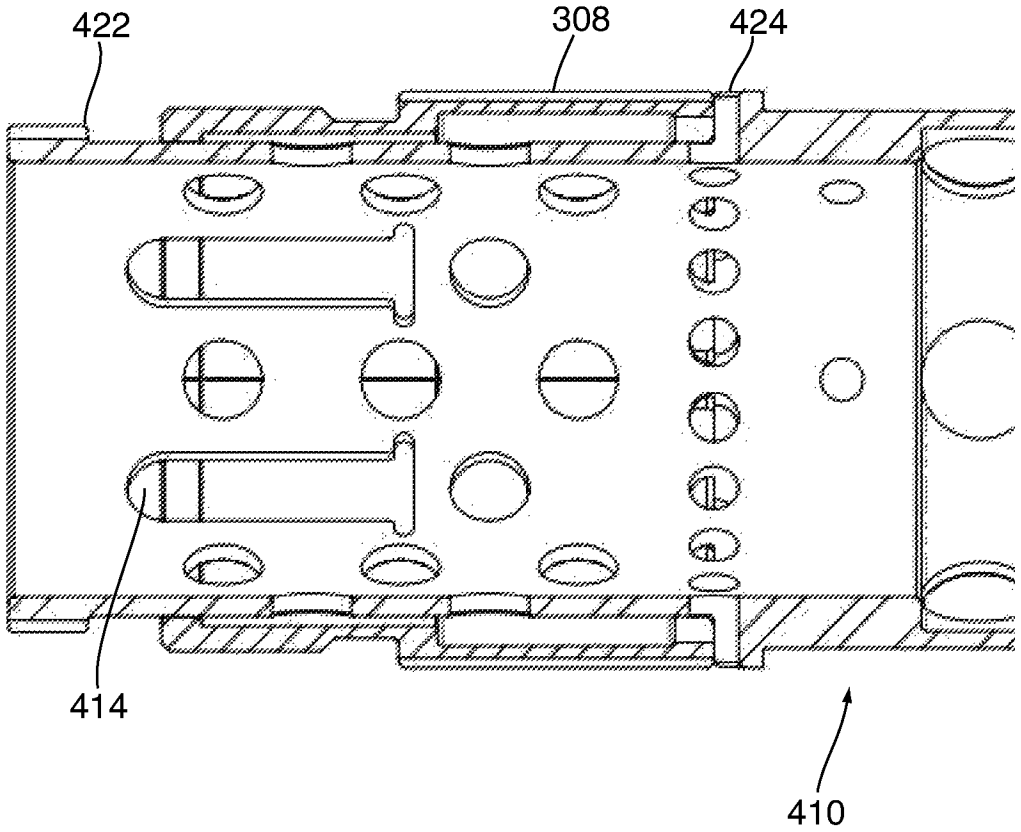
FIG. 3 is a sectional view of a portion of the shifting tool illustrated in FIG. 1, showing a downhole stop of the force transmission member urging the collar in an uphole direction, such that a force in an uphole direction is being transmitted from the mandrel via the j-slot, the j-pin, the nut, the resilient member, the downhole stop, the force transmission member and the collar to the collet, and such that the collet is translating with the mandrel in an uphole direction.

Referring to FIGS. 1 to 3, co-operation between the locator 300 (and, more specifically, with respect to the illustrated embodiment, the wellbore coupler 304) and the displacement impeder 600 is now described. The wellbore coupler 304 is retained relative to the wellbore coupler release opposer 400 via a collar 308. The collar 308 is threaded to a downhole end of the wellbore coupler 304. The force transmission member 410 extends through the collar 308 such that the collar 308 is captured and retained between uphole and downhole stops 422, 424 projecting outwardly from the force transmission member 410.

Referring to FIGS. 1 and 2, the uphole stop 422 is configured to transmit a downhole force (such as one being applied via a workstring) from the conveyance member 201, via the j-pin 406, rotatable mandrel 404, alignment pins 412, and slots 414 of the force transmission member 410, to the wellbore coupler 304 via the collar 308, thereby urging the wellbore coupler 304 in a downhole direction, against at least the frictional resistance of the wellbore string 504 versus the wellbore coupler 304, which is resisting the downhole travel of the wellbore coupler 304. In some embodiments, for example, the translation of the wellbore coupler 304 with the conveyance member 201 in a downhole direction, is also effected via urging of the wellbore coupler 304, via the collar 308, by the force transmission member 410.

Referring to FIGS. 1 and 3, the downhole stop 424 is configured to transmit an uphole force, being applied to the conveyance member 201, from the conveyance member 201, via the j-slot 202, the j-pin 406, rotatable mandrel 404, the resilient member 414, and the force transmission member 410, and also via the displacement impeder 600 (through the lower castellation 620, such as, for example, via engagement between the lower castellation 620 and the second pusher 612 while an uphole pulling force is being applied to the conveyance member 201) and the upper castellation 420, to the wellbore coupler 304 via the collar 308, thereby urging displacement of the wellbore coupler 304 in an uphole direction, against at least the frictional resistance of the wellbore string 504 versus the wellbore coupler 304, which is resisting the uphole displacement of the wellbore coupler 304.

Not every stroke of the conveyance member 201 is configured to effect an actuation of the gripper 700.

For example, not every downhole stroke of the conveyance member 201 is configured for effecting actuation of the gripper 700 such that, for example, the gripper 700 becomes disposed in the first gripping position. In this respect, in some embodiments, for example, it is preferable to avoid actuation of the gripper 700 for those downhole strokes where it is intended to displace the shifting tool 100, relative to the wellbore, such that selective positioning of the shifting tool 100 is enabled, where such selective positioning requires that the shifting tool pass several stages before becoming disposed at the desired position where the gripper 700 should be actuated. Actuating the gripper 700 in these circumstances only interferes with the operation of selective positioning of the shifting tool 100.

Similarly, for example, not every uphole stroke of the conveyance member 201 is configured for effecting actuation of the gripper 700 such that, for example, the gripper 700 becomes disposed in the second gripping position. In this respect, in some embodiments, for example, it is preferable to avoid actuation of the gripper 700 for those uphole strokes (e.g. a "locating stroke") where it is intended to displace the shifting tool 100, relative to the wellbore, for effecting locating of the shifting tool 100. Actuating the gripper 700 in these circumstances, prior to successful locating, only interferes with the operation of locating of the shifting tool 100.

To control which uphole strokes of the conveyance member 201 effect actuation of the gripper 700 to the second gripping position, the conveyance member 201 includes the j-slot 202, which limits displacement of the conveyance member 201 (with which the setting cone 216 translates) relative to the gripper 700 (whose position is determined by the wellbore coupler 304) depending on the length of slot portions that the j-pin 406 traverses during the uphole strokes. Slot portion 202A, through which the j-pin 406 is movable during a first uphole stroke, is of insufficient distance to enable sufficient uphole displacement of the conveyance member 201 relative to the locator 300, and thereby effect sufficient displacement of the setting cone 216, from its starting position at the beginning of the first uphole stroke (corresponding to position 220A of the j-pin 406), relative to the gripper 700, to effect actuation of the gripper 700 (for example, to the second gripping position), whereas slot portion 202C, through which the j-pin 406 is movable during a second uphole stroke, is of sufficient distance to enable sufficient displacement of the conveyance member 201 relative to the wellbore coupler 304, and thereby effect sufficient displacement of the setting cone 216, from its starting position at the beginning of the second downhole stroke (corresponding to position 220C of the j-pin 202), relative to the gripper 700, to effect actuation of the gripper 700 to the second gripping position. In this respect, the actuation of the gripper 700 to the gripping position is effectible during the second uphole stroke of the conveyance member 201 (a gripper actuating stroke), but not the first uphole stroke of the conveyance member 201.

Co-operatively, the upper castellation 420 is rotatable relative to the lower castellation 620, between the first uphole stroke (a locating stroke) and the second uphole stroke (a gripper actuating stroke), such that the orientation of the upper castellation 420 relative to the lower castellation 620 changes from one where nesting of the upper castellation 420 within the lower castellation 620 is prevented to one where the upper castellation 420 is nested within the upper castellation 620 during the second uphole stroke (a gripper actuating stroke). The relative rotation between the upper and lower castellations 420, 620 is responsive to the travel of the j-pin 406 through the j-slot 202 between the first and second uphole strokes (compare FIGS. 19B and 19G) to effect such change in positioning of the upper castellation 420 relative to the lower castellation.

The prevention of nesting of the upper castellation 420 within the lower castellation 620 (see FIG. 19G) is with effect that the impeding of displacement of the conveyance member 201 is avoided, so that the gripping operation (during a gripper actuating stroke) is not unnecessarily delayed. By co-operatively configuring the locator 300, the conveyance member 201, the gripper actuator 208 (or 216), the gripper 700 and the displacement impeder 600, during a first stroke (a locating stroke) of the conveyance member 201, the j-tool establishes positioning of the upper castellation 420 relative to the lower castellation 620 such that: (i) nesting of the upper castellation 420 within the lower castellation 620 is effected, and (ii) actuation of the gripper 700 is prevented, and during a second stroke (a gripper actuation stroke) of the conveyance member 201, the j-tool establishes positioning of the upper castellation 420 relative to the lower castellation 620 such that: (i) nesting is prevented, (ii) actuation of the gripper 700 is effectuated.

In some embodiments, for example, the second gripper actuator 216 is configured for becoming sheared.

Figure 21:
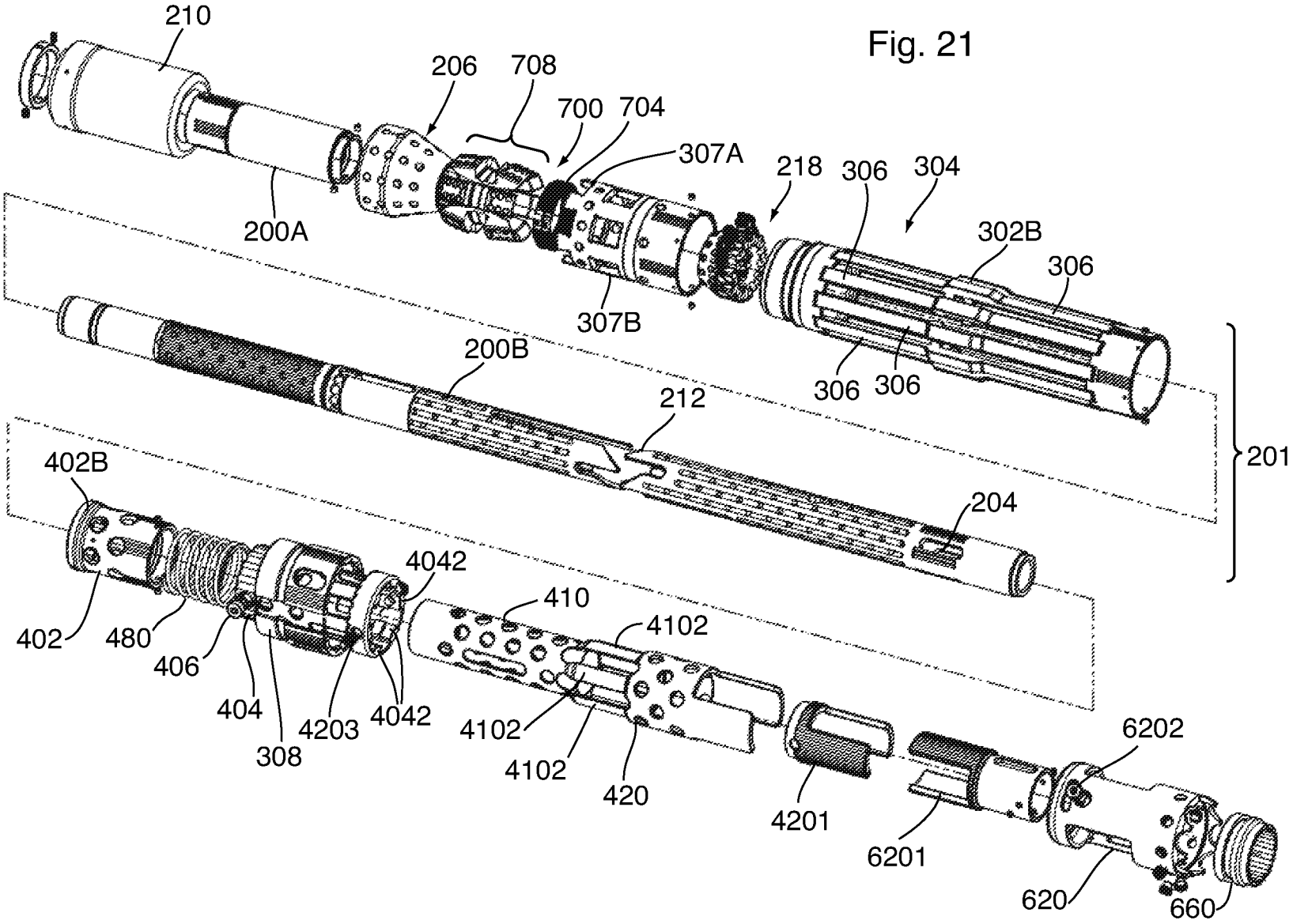
FIG. 21 is an exploded perspective view of another embodiment of a shifting tool of the present disclosure.
Figure 22:
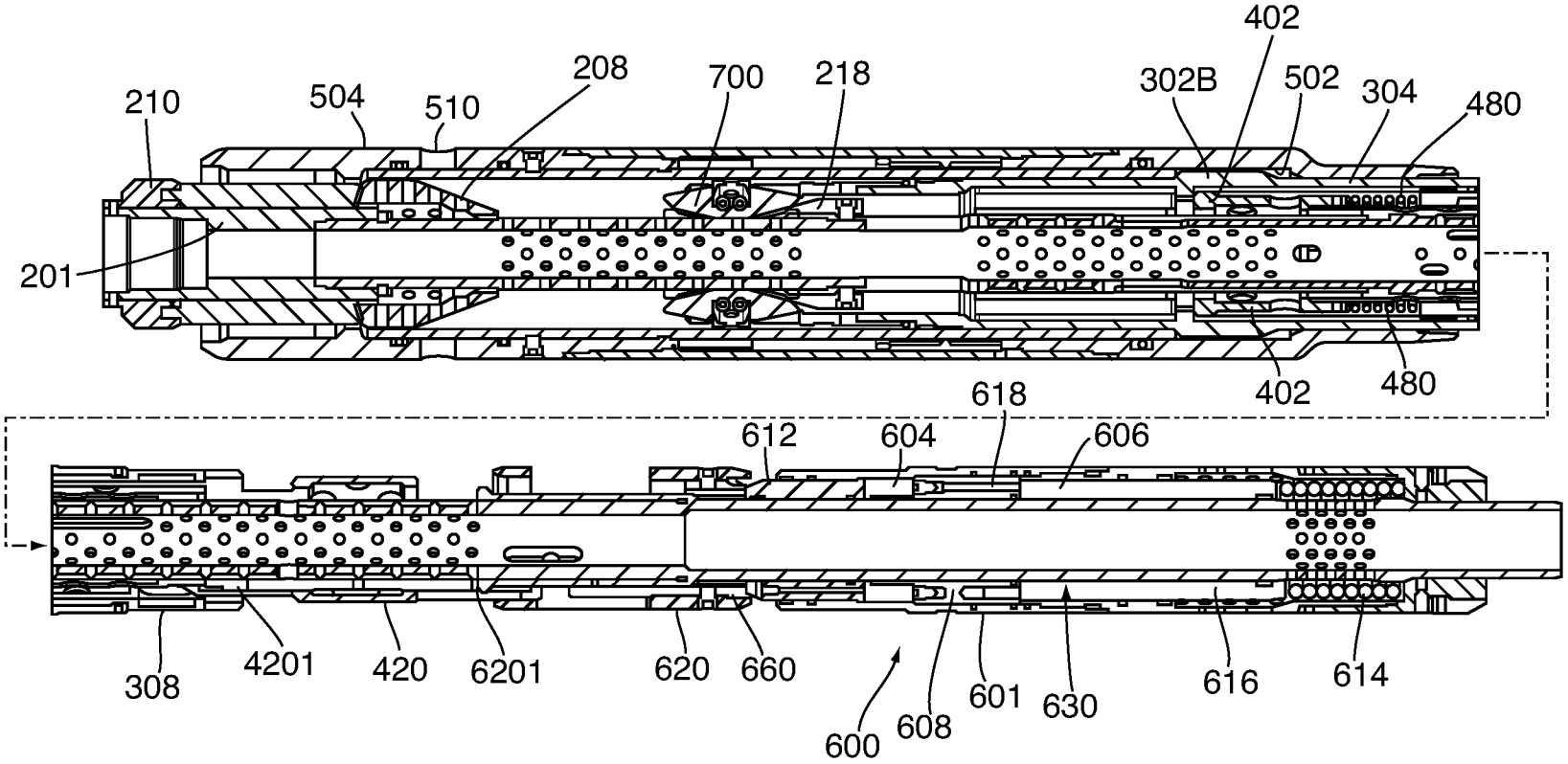
FIG. 22 is a sectional view of the shifting tool illustrated in FIG. 21, deployed within a wellbore string, and disposed in a condition after having become located within a locate profile.

Referring to FIGS. 21 and 22, in some embodiments, for example, the opposing of the release of the wellbore coupler 304 from retention relative to the wellbore feature 502 (such as, for example the locate profile 502), by the wellbore coupler release opposer 400, includes impeding the release of the wellbore coupler 304 from retention relative to the locate profile 502. In some embodiments, for example, the impeding of the release of the wellbore coupler 304 from retention relative to the wellbore feature 502 includes impeding displacement of the engagement member 302 from an extended position (such as, for example, (while the engagement member 302 is disposed within the locate profile 502, such as, for example, while the wellbore coupler 304 is being releasably retained by the locate profile 502) to the retracted position (such as, for example, while the wellbore coupler 304 is released from retention relative to the wellbore feature 502).

In some embodiments, for example, the wellbore coupler displacement-opposing member 402 is configured for effecting the impeding of displacement of the engagement member 302 from an extended position (such as, for example, (while the engagement member 302 is disposed within the locate profile 502, such as, for example, while the wellbore coupler 304 is being releasably retained by the locate profile 502) to the retracted position (such as, for example, while the wellbore coupler 304 is released from retention relative to the wellbore feature 502).

In this respect, in some embodiments, for example, the normal axis of the engagement surface 304B of the wellbore coupler displacement-opposing member 402 is disposed at an acute angle relative to the axis along which the engagement member 302 is displaced from the extended position to the retracted position. In some embodiments, for example, the acute angle is between 10 degrees and 65 degrees. In some embodiments, for example, the acute angle is between 45 degrees and 60 degrees, such as about 53 degrees. In some embodiments, for example, the acute angle is between 15 degrees and 25 degrees, such as about 20 degrees.

In some embodiments, for example, the normal axis of the engagement surface 402B of the wellbore coupler displacement-opposing member 402 is disposed at an acute angle relative to a central longitudinal axis 3021 of the conveyance member 301. In some embodiments, for example, the acute angle is between 25 degrees and 80 degrees. In some embodiments, for example, the acute angle is between 30 degrees and 45 degrees, such as about 38 degrees. In some embodiments, for example, the acute angle is between 65 degrees and 80 degrees, such as about 70 degrees.

Figures 5A, 5B, 5C:
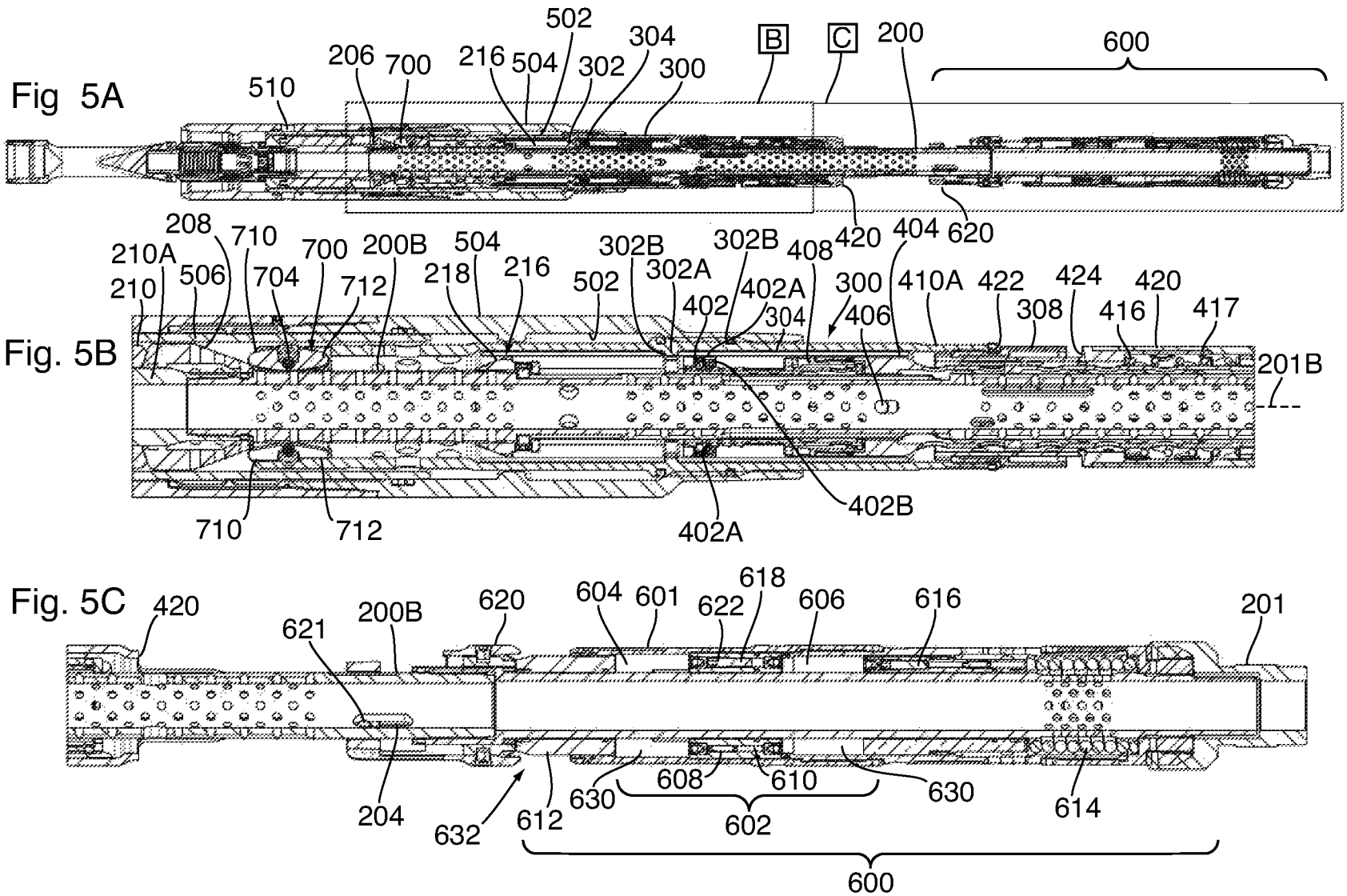
FIG. 5A is a sectional view of the shifting tool illustrated in FIG. 1, deployed within a wellbore string, and disposed in a run-in-hole condition, prior to locating.
FIG. 5B is an enlarged view of Detail "B' of FIG. 5A.
FIG. 5C is an enlarged view of Detail "C' of FIG. 5A.
Figure 6A:
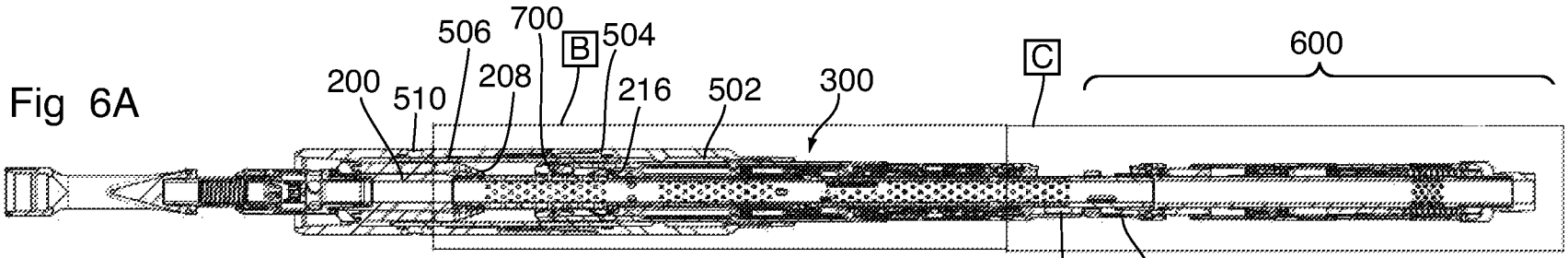
FIG. 6A is a sectional view of the shifting tool illustrated in FIG. 1, deployed within a wellbore string, and disposed in a pull-out-of-hole condition.
Figure 6B:
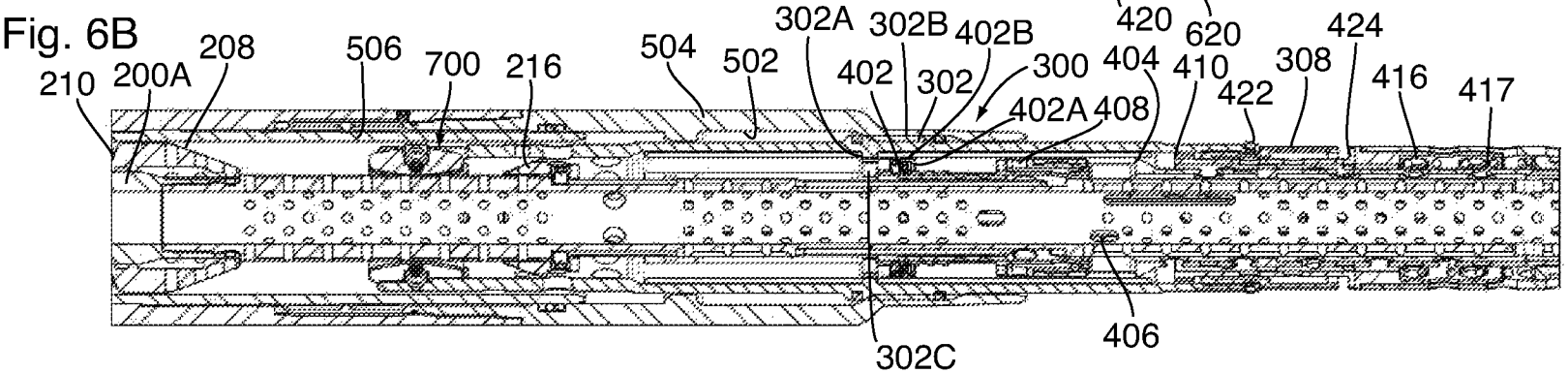
FIG. 6B is an enlarged view of Detail "B' of FIG. 6A.
Figure 6C:
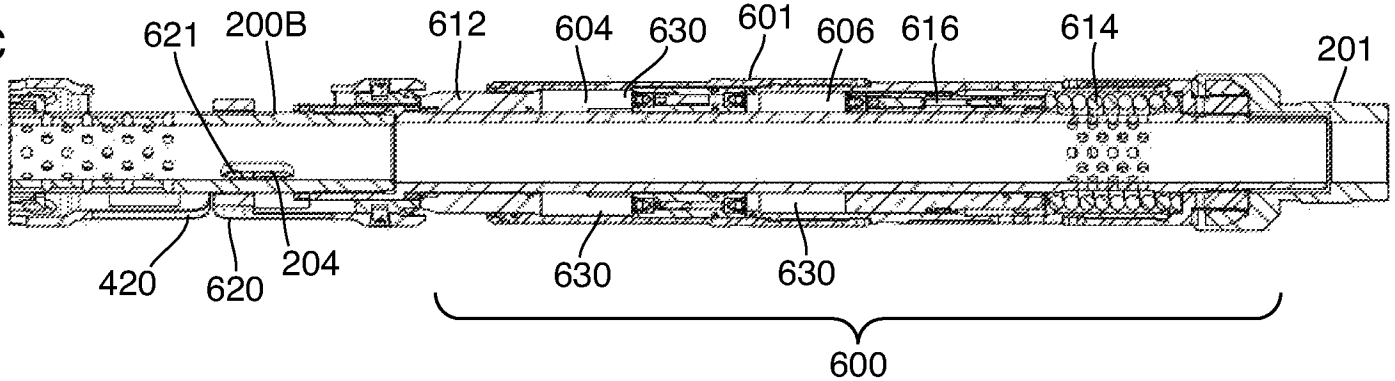
FIG. 6C is an enlarged view of Detail "C' of FIG. 6A.
Figure 7A:
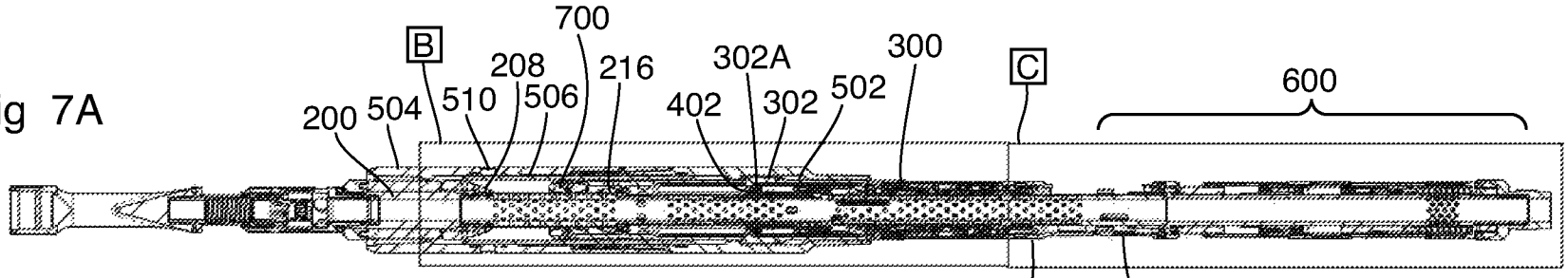
FIG. 7A is a sectional view of the shifting tool illustrated in FIG. 1, deployed within a wellbore string, and disposed in a condition after having become located within a locate profile.
Figure 7B:
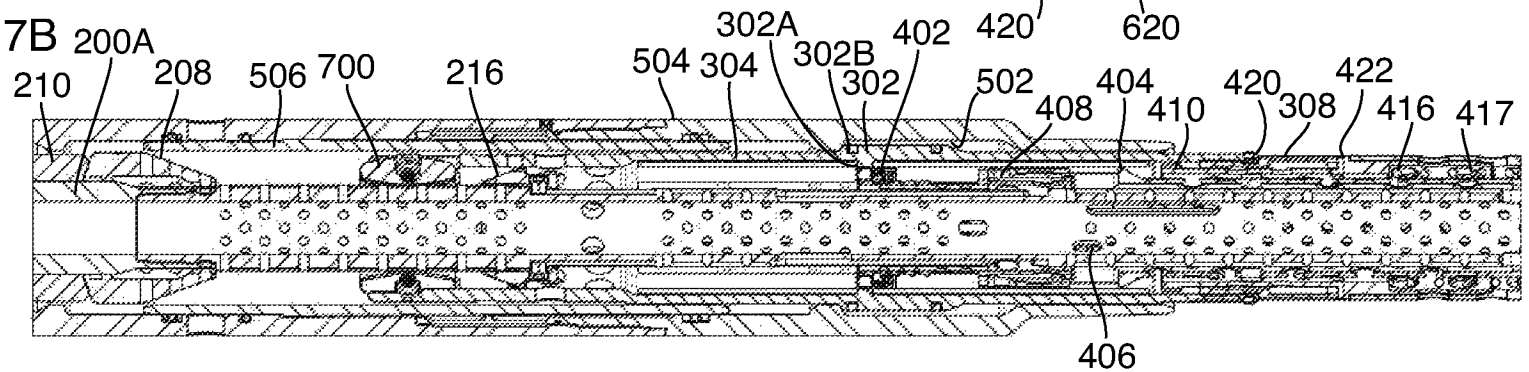
FIG. 7B is an enlarged view of Detail "B' of FIG. 7A.
Figure 7C:
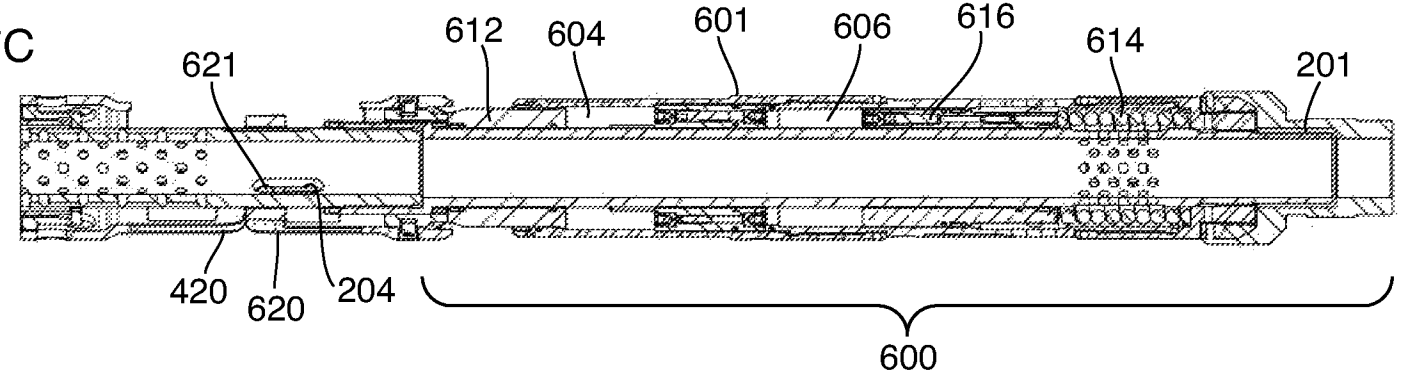
FIG. 7C is an enlarged view of Detail "C' of FIG. 7A.
Figure 8A:
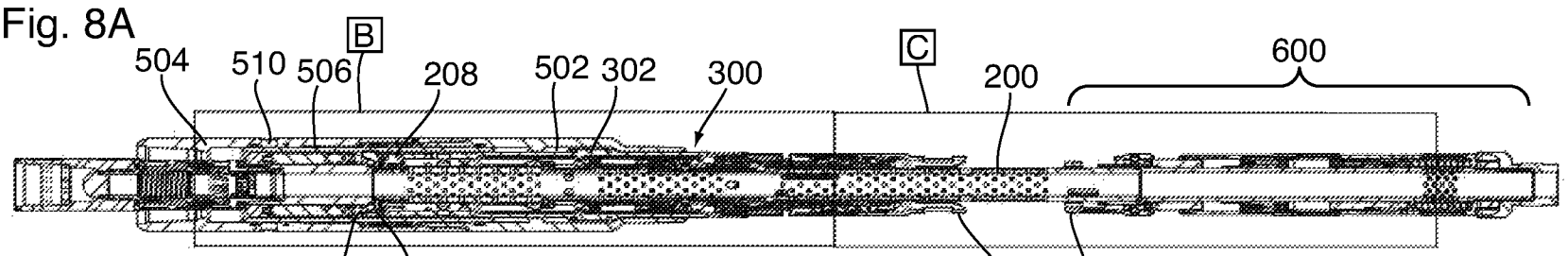
FIG. 8A is a sectional view of the shifting tool illustrated in FIG. 1, deployed within a wellbore string, and disposed in a set down condition.
Figure 8B:
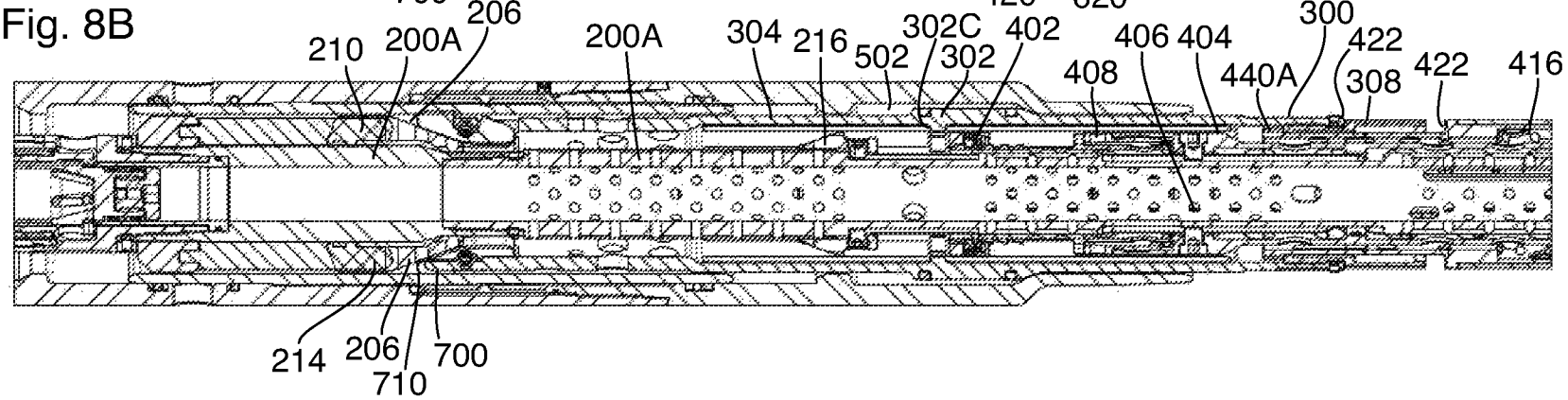
FIG. 8B is an enlarged view of Detail "B' of FIG. 8A.
Figure 8C:
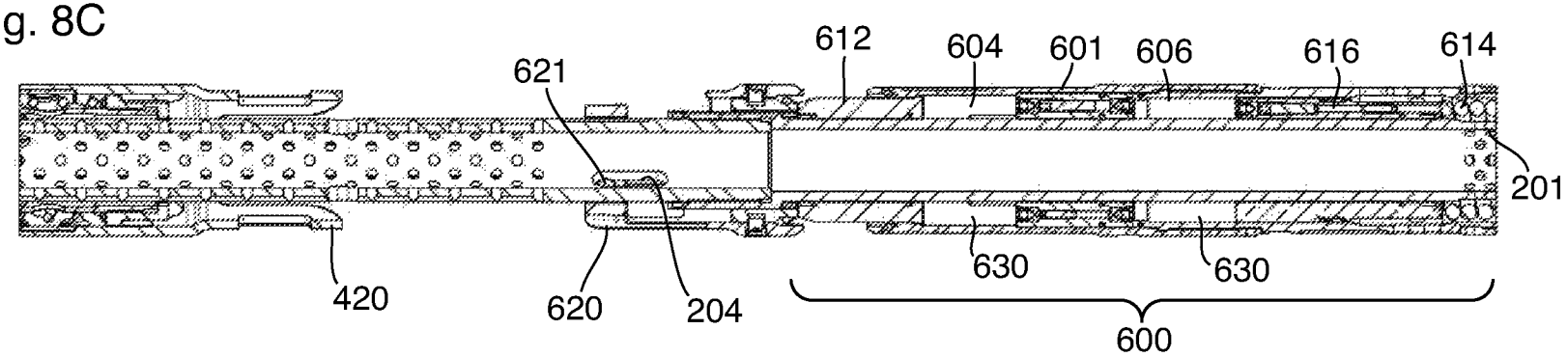
FIG. 8C is an enlarged view of Detail "C' of FIG. 8A.
Figures 9A, 9B, 9C:
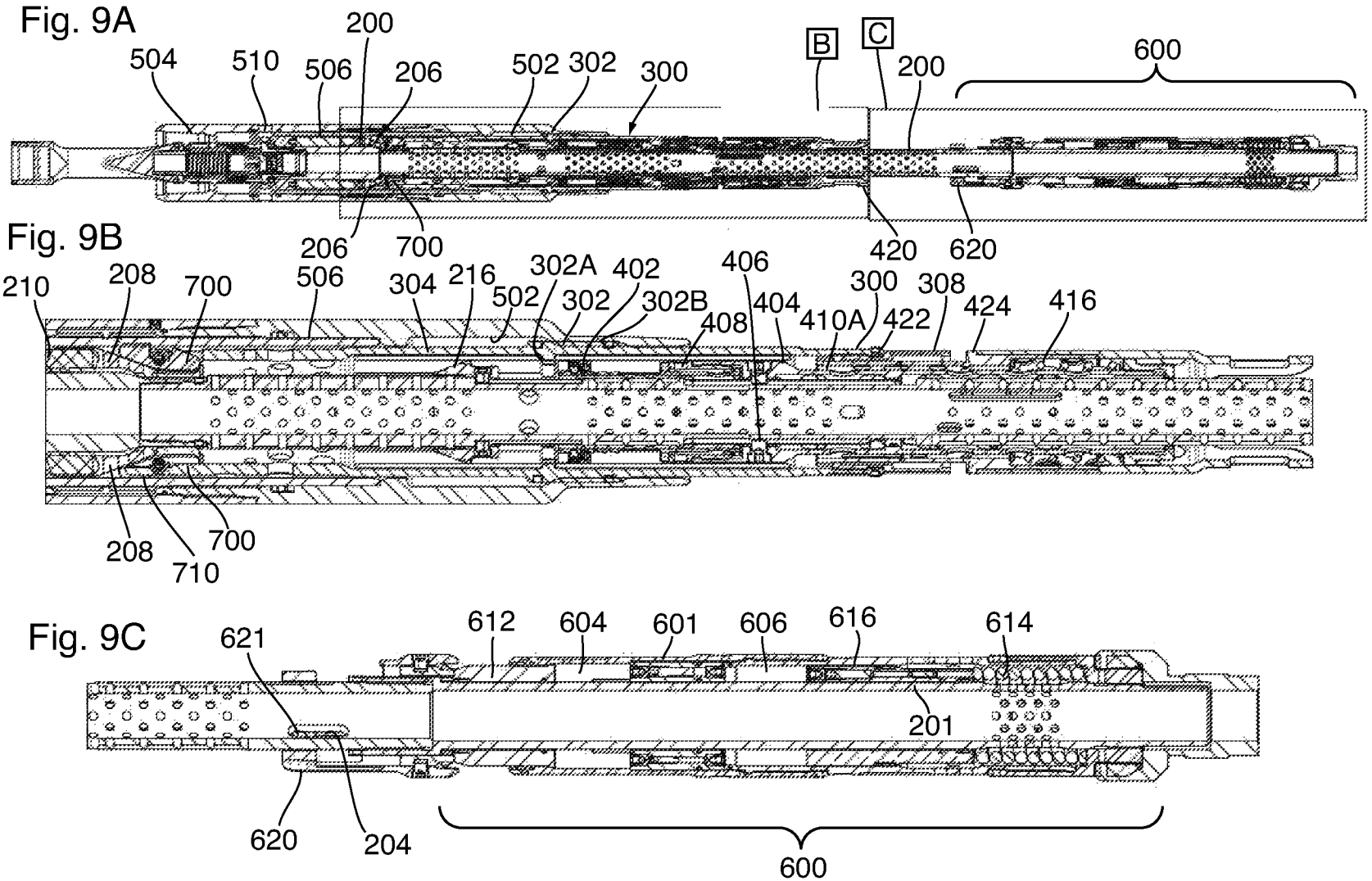
FIG. 9A is a sectional view of the shifting tool illustrated in FIG. 1, deployed within a wellbore string, and disposed in a condition after having after effected opening of a port.
FIG. 9B is an enlarged view of Detail "B' of FIG. 9A.
FIG. 9C is an enlarged view of Detail "C' of FIG. 9A.
Figures 10A, 10B, 10C:
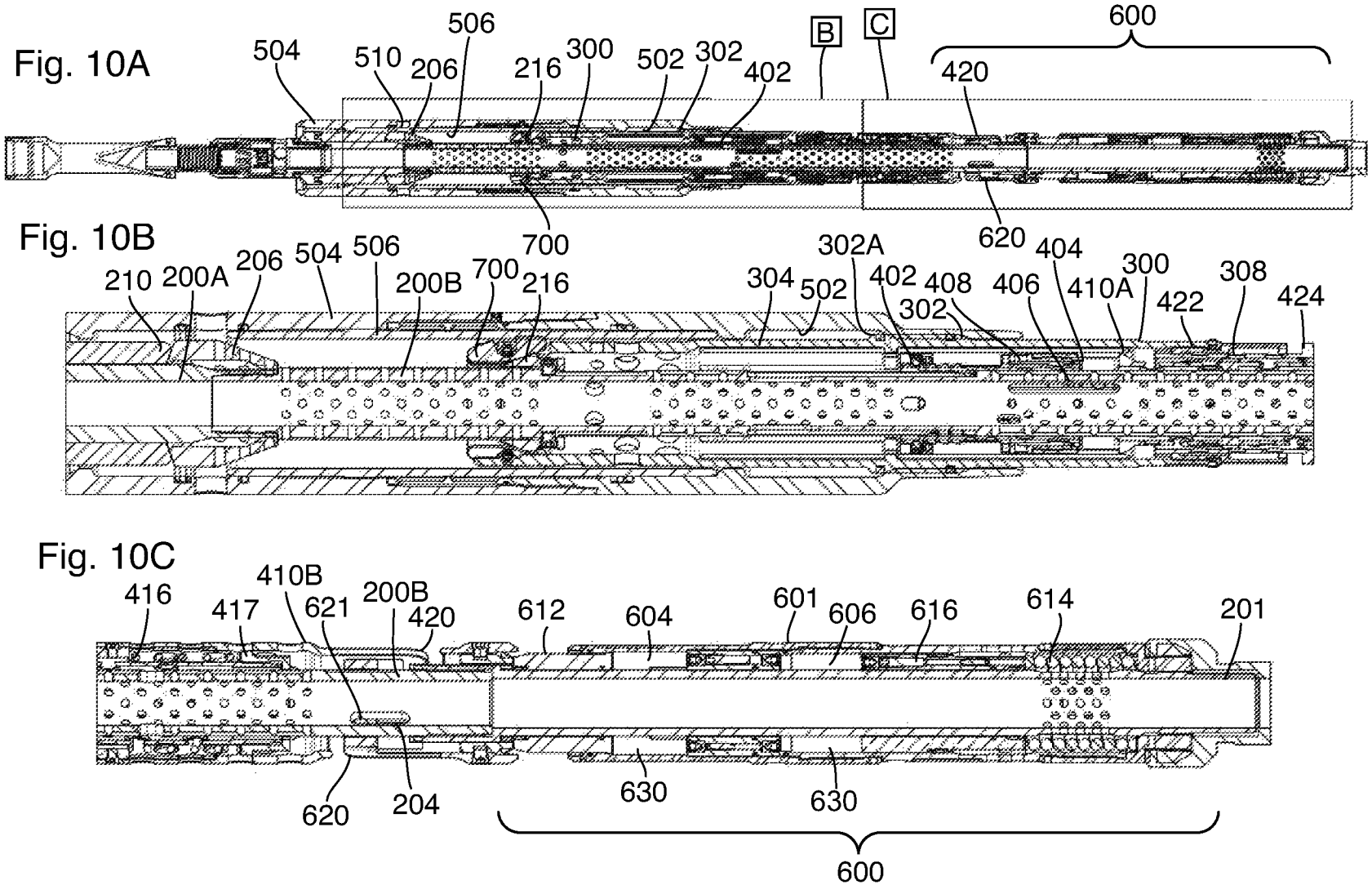
FIG. 10A is a sectional view of the shifting tool illustrated in FIG. 1, deployed within a wellbore string, and disposed in a tension set condition for effect closing of the port.
FIG. 10B is an enlarged view of Detail "B' of FIG. 10A.
FIG. 10C is an enlarged view of Detail "C' of FIG. 10A.
Figures 11A, 11B, 11C:
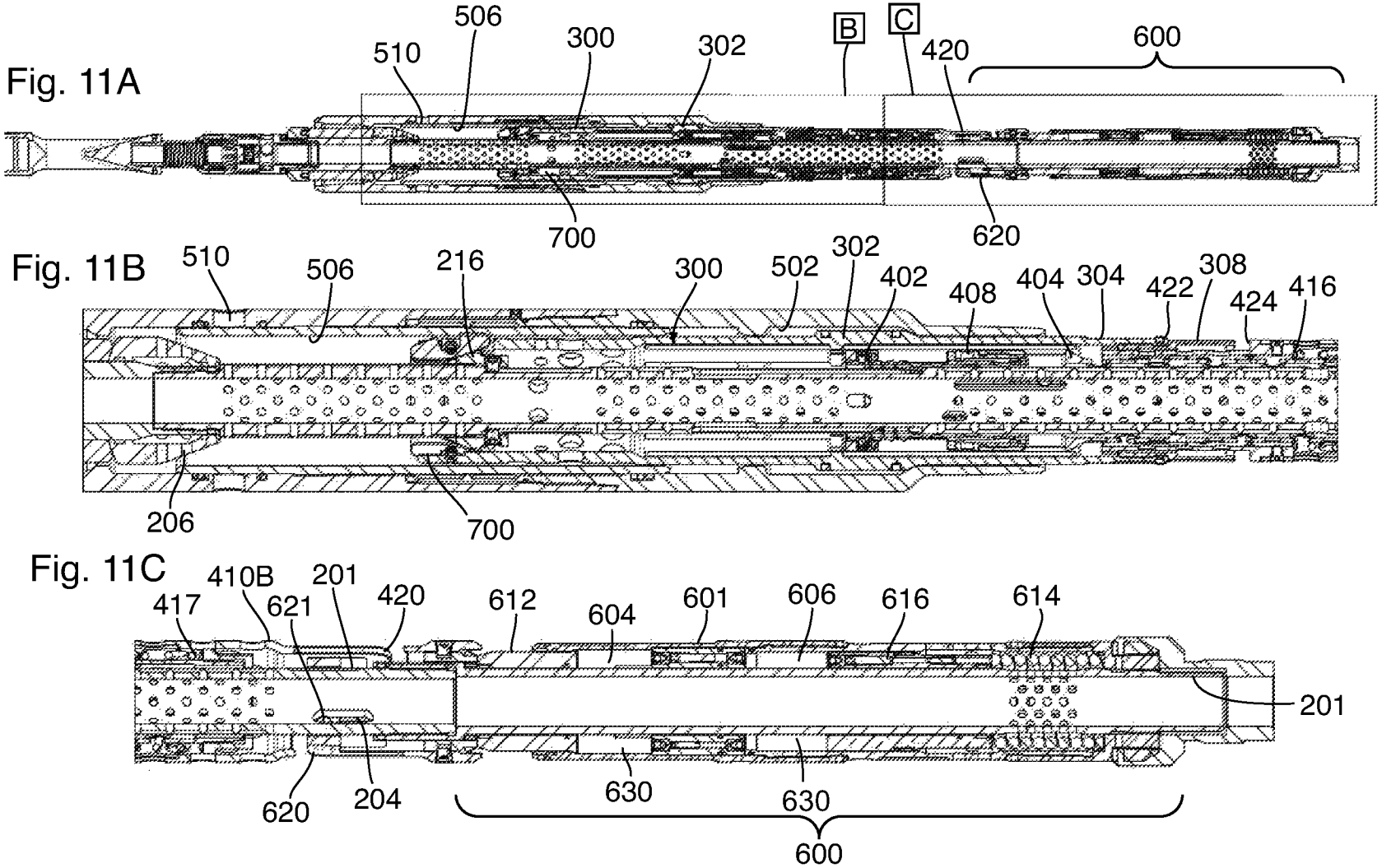
FIG. 11A is a sectional view of the shifting tool illustrated in FIG. 1, deployed within a wellbore string, and disposed in a condition after having effected closing of a port.
FIG. 11B is an enlarged view of Detail "B' of FIG. 11A.
FIG. 11C is an enlarged view of Detail "C' of FIG. 11A.
Figure 12A:
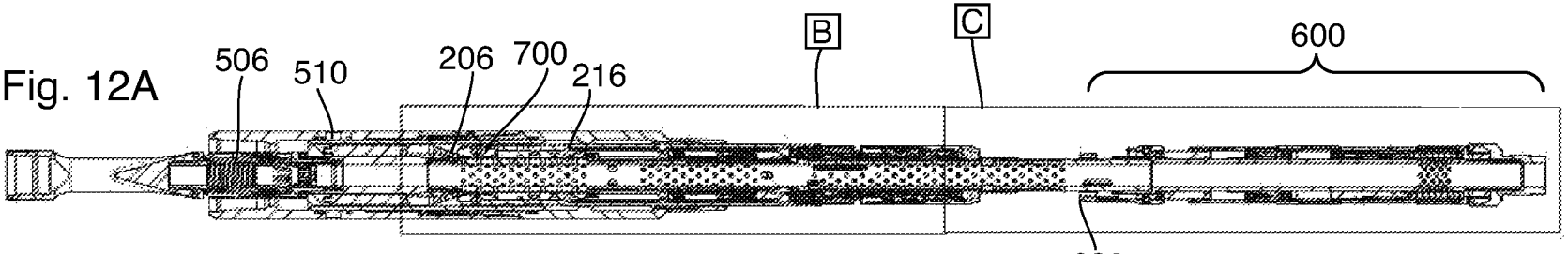
FIG. 12A is a sectional view of the shifting tool illustrated in FIG. 1, deployed within a wellbore string, and disposed in a run-in-hole condition, after having effected closing of the port, for unsetting the gripper.
Figure 12B:
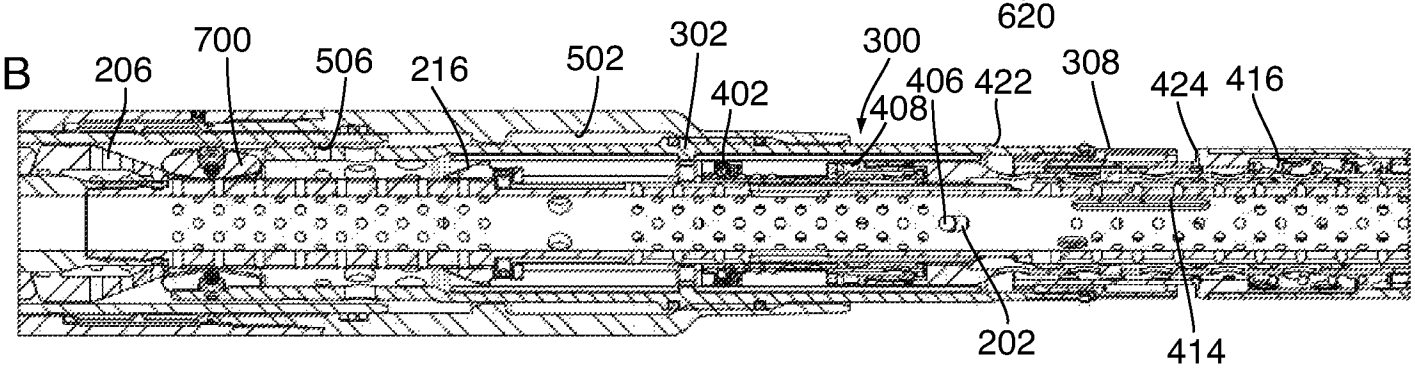
FIG. 12B is an enlarged view of Detail "B' of FIG. 12A.
Figure 12C:
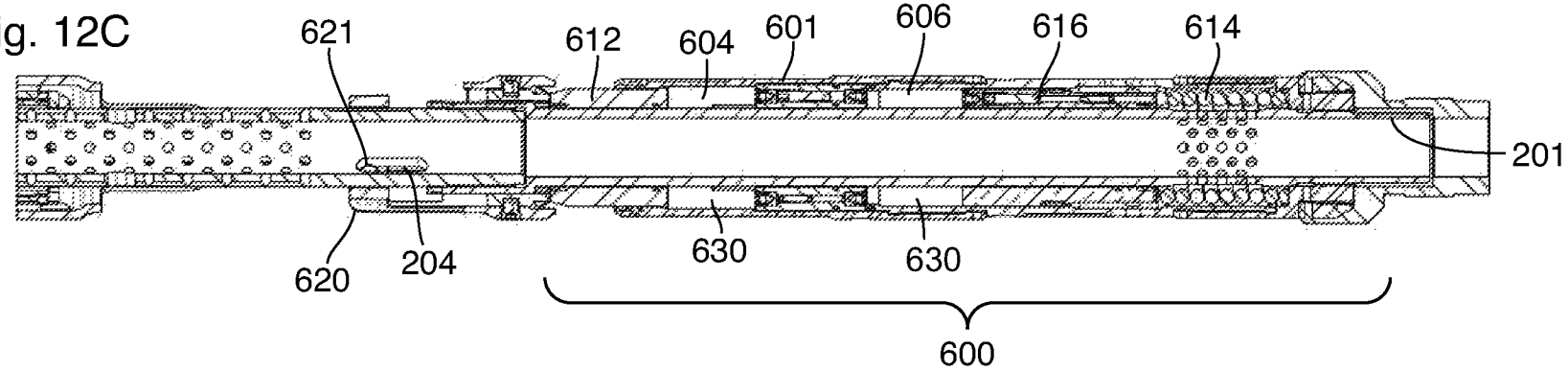
FIG. 12C is an enlarged view of Detail "C' of FIG. 12A.
Figure 13A:
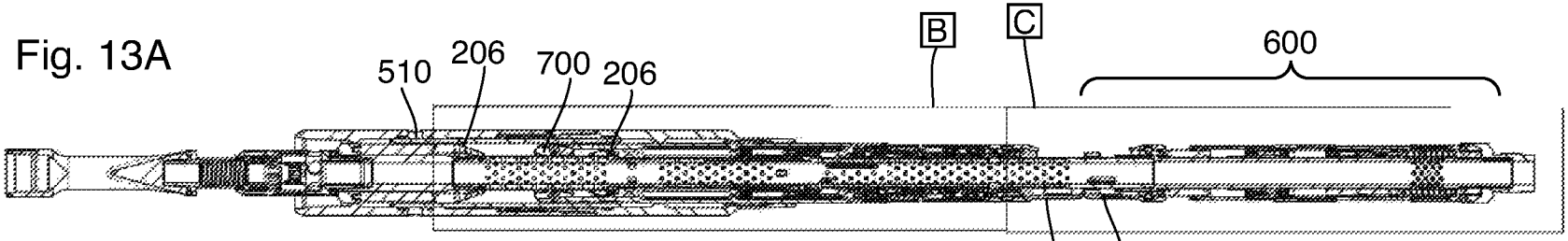
FIG. 13A is a sectional view of the shifting tool illustrated in FIG. 1, deployed within a wellbore string, and disposed in a pull-out-of-hole condition, after having unset the gripper, for becoming displaced uphole relative to the wellbore.
Figure 13B:
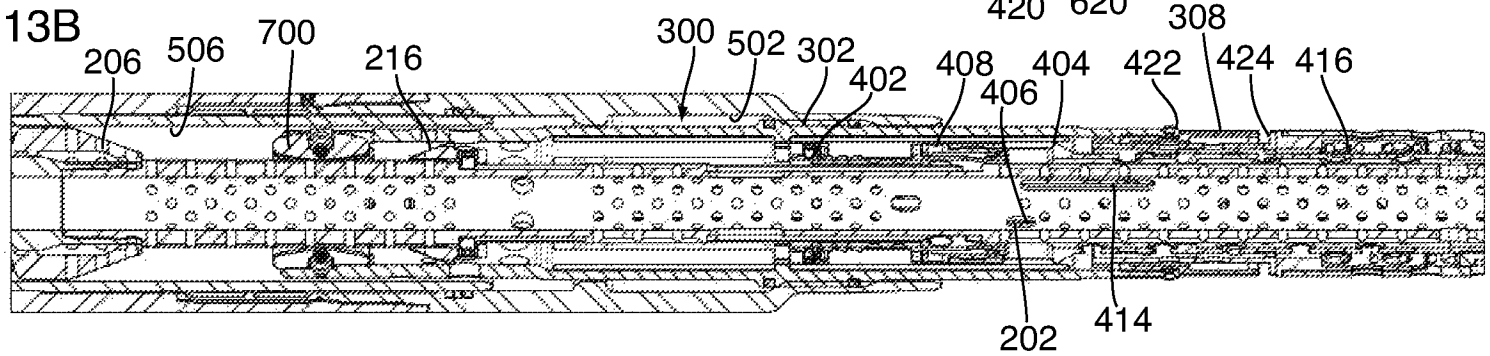
FIG. 13B is an enlarged view of Detail "B' of FIG. 13A.
Figure 13C:
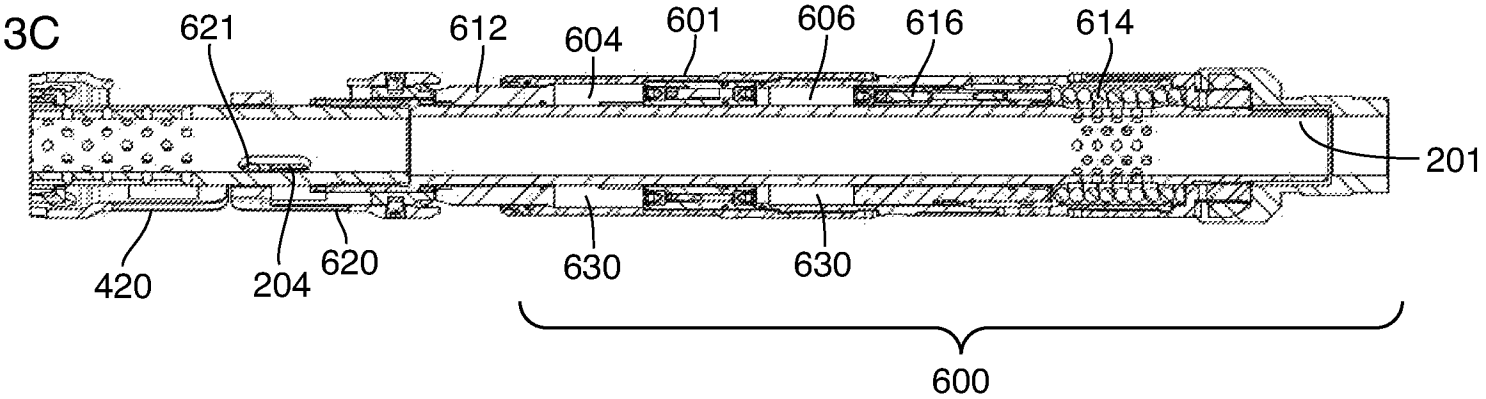
FIG. 13C is an enlarged view of Detail "C' of FIG. 13A.
Figure 14A:
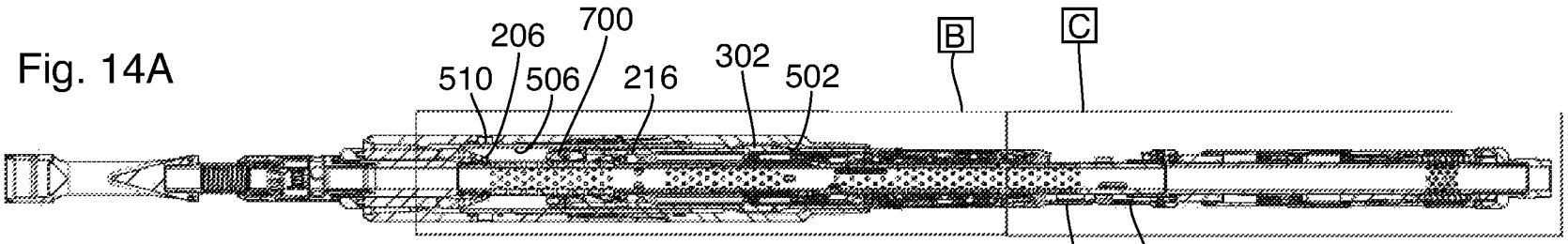
FIG. 14A is a sectional view of the shifting tool illustrated in FIG. 1, deployed within a wellbore, and disposed in a condition after having been displaced further uphole relative to the position in which it is illustrated in FIGS. 13A, 13B and 13C, and after having become disposed within and located within the same locate profile as in FIGS. 7A, 7B, and 7C.
Figure 14B:
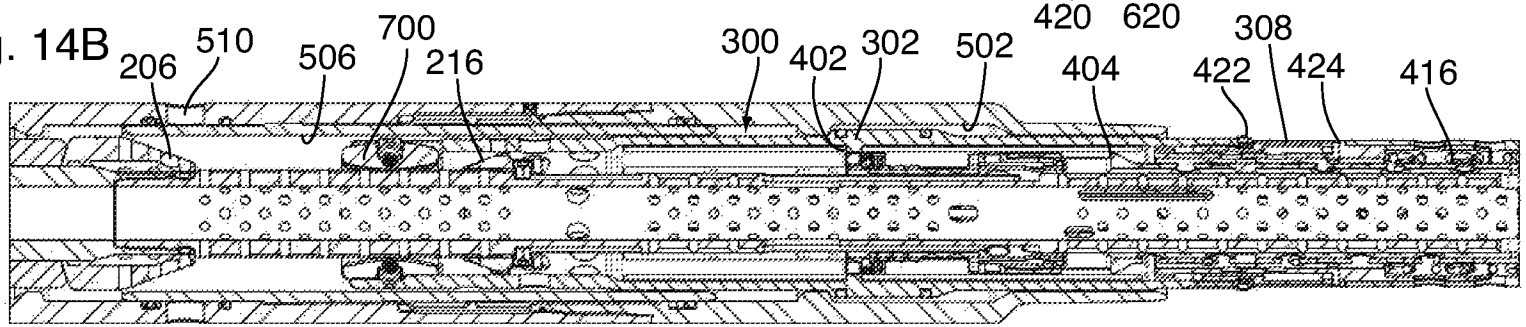
FIG. 14B is an enlarged view of Detail "B' of FIG. 14A.
Figure 14C:
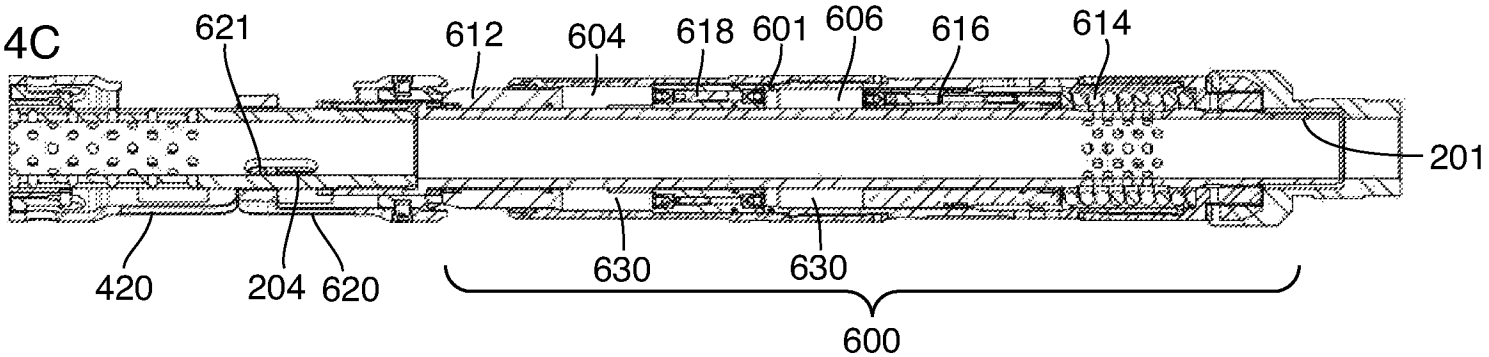
FIG. 14C is an enlarged view of Detail "C' of FIG. 14A.
Figure 15A:
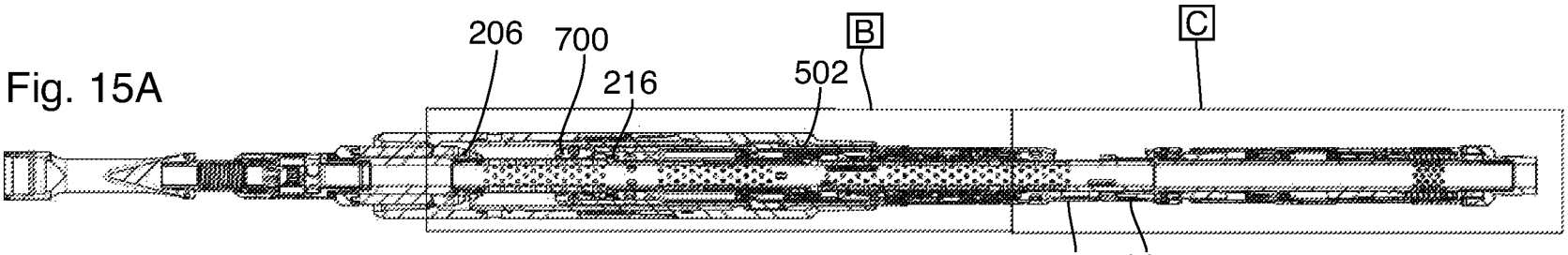
FIG. 15A is a sectional view of the shifting tool illustrated in FIG. 1, deployed within a wellbore, and disposed in a locate profile, after having the keeper displaced further uphole relative to its position illustrated in FIGS. 14A, 14B and 14C such that the collet has become unseated.
Figure 15B:
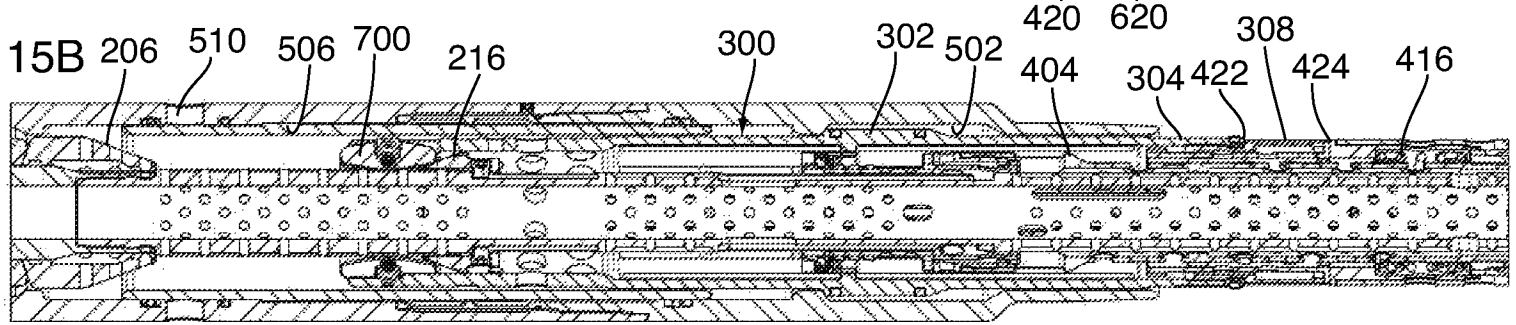
FIG. 15B is an enlarged view of Detail "B' of FIG. 15A.
Figure 15C:
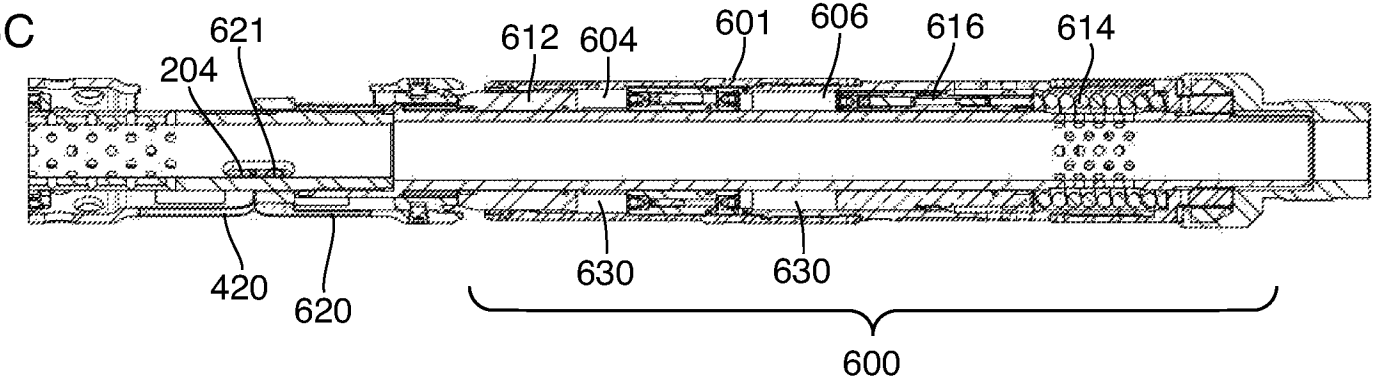
FIG. 15C is an enlarged view of Detail "C' of FIG. 15A.
Figure 16A:
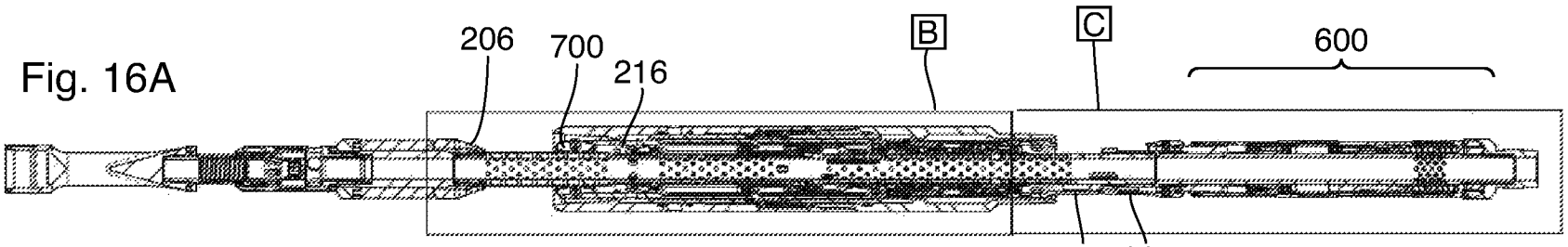
FIG. 16A is a sectional view of the shifting tool illustrated in FIG. 1, deployed within a wellbore, and disposed in a condition after having been displaced further uphole relative to the position in which it is illustrated in FIGS. 15A, 15B and 15C and pulled out of the locate profile.
Figure 16B:
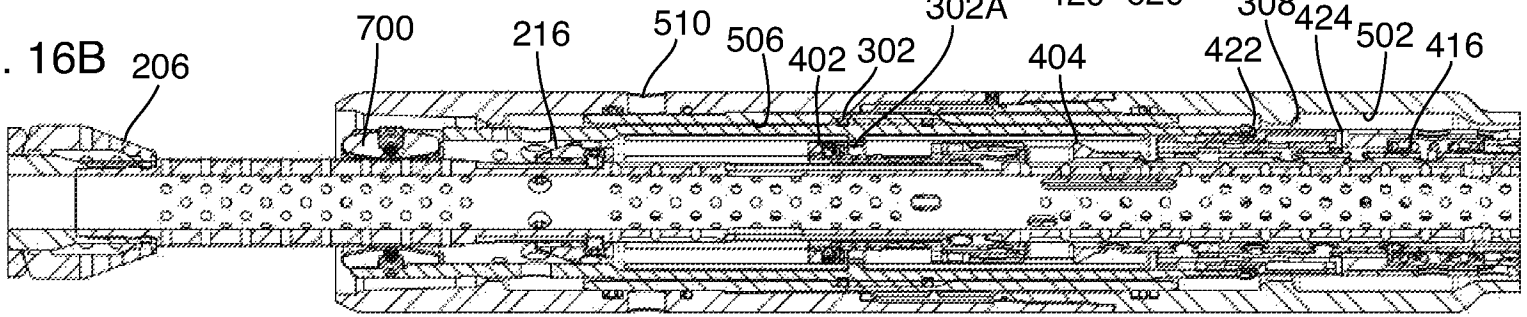
FIG. 16B is an enlarged view of Detail "B' of FIG. 16A.
Figure 16C:
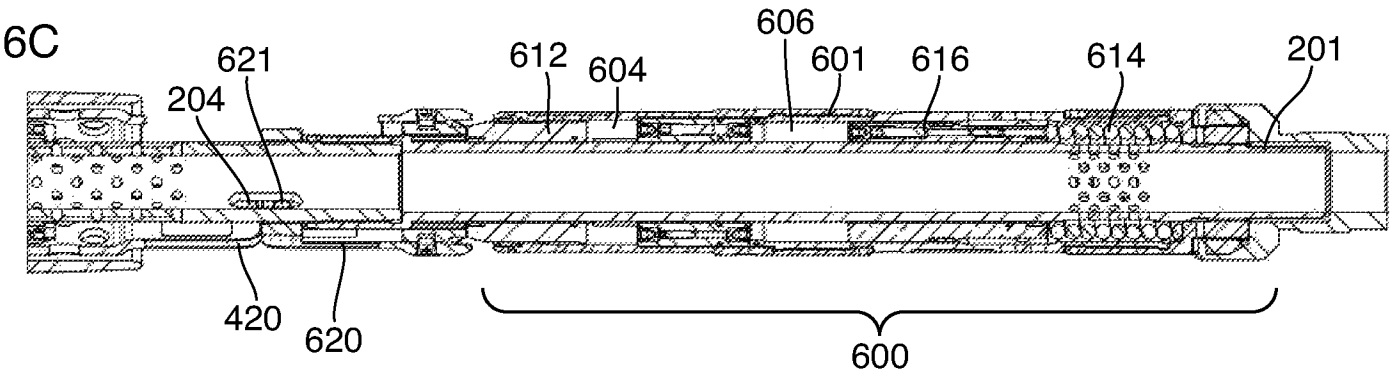
FIG. 16C is an enlarged view of Detail "C' of FIG. 16A.

In some embodiments, for example, the preventing or impeding of the displacement of the engagement member 302 from the locating position to the retracted position, by the wellbore coupler displacement-opposing member 402, is effected by engagement between the protuberance 302A of the wellbore coupler 304 and the engagement surface 402B of the wellbore coupler displacement-opposing member 402 (see FIGS. 5A and 5B). In some embodiments, for example, the engagement is a slidable engagement. In this respect, while disposed in the engagement with the wellbore coupler displacement-opposing member 402, the protuberance 302A is displaceable, relative to the wellbore coupler displacement-opposing member 402, by slidable movement. In some embodiments, for example, the engagement surface 402B of the wellbore coupler displacement-opposing member 402, across which the protuberance 302A is configured to slidably traverse, while the displacement of the wellbore coupler displacement-opposing member 402, relative to the engagement member 302, is being effected for enabling the displacement of the engagement member 302 to the retracted position, has a surface area of at least 0.06 square inches.

In this respect, in another aspect, the engagement member 302 and the wellbore coupler displacement-opposing member 402 are co-operatively configured such that the protuberance 304A is slidably engaged to the engagement surface 402B of the wellbore coupler displacement-opposing member 402, while the displacement of the engagement member 302 to the retracted position is being urged and the wellbore coupler displacement-opposing member 402 is impeding the displacement of the engagement member 302 to the retracted position.

Unlike the embodiment illustrated in FIGS. 1 to 19G, with respect to the embodiment illustrated in FIGS. 21 and 22, the impeding of the displacement of the wellbore coupler displacement-opposing member 402 relative to the retained wellbore coupler 304 is effected by resistance being applied to the wellbore coupler displacement-opposing member 402, impeding its displacement, relative to the wellbore coupler 304, in the downhole direction, while a pulling up force is applied to the conveyance member 201, urging uphole displacement of the wellbore coupler 302, via the collar 308 and the downhole stop 424, as above-described, which, in turn, is urging the downhole displacement of the wellbore coupler displacement-opposing member 402. The resistance is effected by the force transmitter 632.

While the wellbore coupler is releasably retained relative to the locate profile 502, and the wellbore coupler displacement-opposing member 402 is opposing the retraction of the engagement member 302, the coupling of the wellbore coupler displacement-opposing member 402 with the force transmitter 362, for impeding the displacement of the wellbore coupler displacement-opposing member 402 relative to the wellbore coupler 304 (and the engagement member 302) is effected by an uphole pulling force applied to the conveying member, which results in the lower castellation 620 engaging the upper castellation 420. By virtue of this engagement under these circumstances, the lower castellation 620 urges displacement of the second pusher 612, relative to the housing 601, in a downhole direction, which is resisted by fluid within the fluid conductor 602, thereby effecting the impeding of the displacement of the wellbore coupler displacement-opposing member 402 relative to the wellbore coupler 304.

So as to prevent loading of the j-pin 406 on the j-slot 202 during the POOH mode, a second upper castellation 4201 and a second lower castellation 6201 are provided for engagement during the POOH mode, so as to receiving the loading during the POOH mode and mitigate failure of the j-pin 406 which would otherwise be subjected to excessive stress. The second upper castellation 4201 is nested within, and retained axially with set screws 4203 by, the upper castellation 420. The second lower castellation 6201 is rotatably coupled to the lower castellation 620 by a guide pin 6202 that extends through a slot 6203 provided within the lower castellation 6203, and is axially retained relative to the conveying member 201 by set screws. In this respect, the second upper castellation 4201 and the second lower castellation 6201 are co-operatively positionable such that, during the POOH mode, the engaging is effectible, whereas during others modes, the engaging is prevented, and, in some embodiments, for example, with effect that the second lower castellation member 4201 becomes nested with the second upper castellation when the two are displaced relative to one another.

In the embodiment illustrated in FIGS. 21 and 22, the wellbore coupler displacement-opposing member 402 is biased towards a position for effecting the opposing of the displacement of the engagement member 302 from the extended position to the retracted position. In this respect, a resilient member 480, such as a spring, is contained between a shoulder of the wellbore coupler displacement-opposing member 402 and a shoulder of the collar 308.

Like the embodiments illustrated in FIGS. 1 to 19G, coupling of the rotatable mandrel 404 to the conveying member 201 is mediated by a j-tool (i.e. the pin 406 of the mandrel 404 is disposed for travel through the j-slot 202 provided within the conveying member 201). The mandrel 404 extends through the collar 308 and is rotationally coupled to the force transmitter 410 via meshing of complementary ribs 4042, 4102. In this respect, although rotationally constrained relative to the mandrel 404, the force transmitter 410 is movable axially relative to the mandrel 404. Relatedly, the force transmitter 410 is threaded to the wellbore coupler displacement-opposing member 402 so as to enable force transmission to and from the wellbore coupler displacement-opposing member 402.

A method of fluid treatment, using the shifting tool 100, integrated within a workstring, will now be described with reference to the embodiment illustrated in FIGS. 1 to 19G.

The workstring is deployed within a wellbore 500 by running-in-hole (see FIGS. 5A, 5B, 5C and 19A) within a wellbore 500. In this condition, the protuberance 302A is disposed uphole relative to the wellbore coupler displacement-opposing member 402 and the wellbore coupler 304 is spaced-apart from the displacement impeder 600. The wellbore coupler 304 is disposed in a collapsed condition while running in hole, being deflected into the collapsed condition by the wellbore string 504, with the wellbore string 504 providing frictional resistance to relative displacement of the wellbore coupler 304. A force is applied to the workstring in a downhole direction, and transmitted to the conveyance member 201, effecting downhole displacement of the conveyance member 201. The applied force overcomes the frictional resistance of the wellbore string 504, resisting the downhole displacement of the wellbore coupler 304, such that the wellbore coupler 304 translates with the conveyance member 201 in a downhole direction. In this respect, the uphole stop 422 transmits the downhole force, being applied by the workstring, from the conveyance member 201, via the j-slot 202, the j-pin 406, the rotatable mandrel 404, the alignment pins 412, the slots 414 of the force transmission member 410, to the wellbore coupler 304 via the collar 308, thereby urging the wellbore coupler 304 in a downhole direction, against at least the frictional resistance of the wellbore string 504 versus the wellbore coupler 304. In some embodiments, for example, the translation of the wellbore coupler 304, downhole with the conveyance member 201, is also effected via urging by the wellbore coupler displacement-opposing member 402 which is translating with the conveyance member 201 via the j-slot 202, the j-pin 406, the rotatable mandrel 404, and the collar 408. During this run-in-hole ("RIH") mode, the j-pin 406 is disposed in position 220A within the j-slot 202 (see FIG. 4).

The workstring is lowered such that the locator 300 becomes positioned downhole relative to an estimated location of the locate profile 502. The travel of the locator 300 is then reversed. In this mode, the shifting tool 100 is disposed in the pull-out-of-hole ("POOH") mode. Referring to FIGS. 4, 6A, 6B, 6C and 19B, during the POOH mode, the j-pin becomes disposed in position 220B within the j-slot 202 (see FIG. 4), and in having the j-pin 406 become displaced from position 220A to position 220B, rotation of the rotatable mandrel 404 relative to the conveyance member 201 is effected, and, in turn, rotation of the upper castellation 420 relative to the lower castellation 620, such that the upper and lower castellations 420, 620 become suitably oriented in the first orientation (see above) such that the lower castellation 420 becomes disposed in force transmission communication with the force transmitter 632 via the upper castellation 620 (see FIG. 19B) for effecting impeding of the displacement of the conveyance member 201, as well as displacement of wellbore coupler displacement-opposing member 402 relative to the located wellbore coupler 304, in response to application of an uphole pulling force to the conveyance member 201. As mentioned above, this provides an operator, at the surface, with sufficient time to identify an indication that the wellbore coupler 304 has become releasably retained (i.e. has been located) relative to the locate profile 502 (e.g. an increase in force required to displace the wellbore coupler 304 from the locate profile 502).

While the conveyance member 201 is being pulled uphole (such that a locating stroke is effected), the downhole stop 424 transmits the uphole force being applied to the conveyance member 201, via the force transmission member 410 (via the j-slot 202, the j-pin 406, rotatable mandrel 404, and the resilient member 414), and also via the displacement impeder 600 (through the lower castellation 620) and the upper castellation 420, to the wellbore coupler 304 via the collar 308, thereby urging the wellbore coupler 304 in an uphole direction, against at least the frictional resistance of the wellbore string 504 versus the wellbore coupler 304, which is resisting the uphole displacement of the wellbore coupler 304. Upon alignment between the engagement member 302 and the locate profile 502, the wellbore coupler 304 becomes expanded, owing to the bias of the collet springs, with effect that the engagement member 302 becomes disposed in the locate profile 302, thereby effecting releasable retention of the wellbore coupler 304 relative to the locate profile 502, and the protuberance 302A becomes seated upon the wellbore coupler displacement-opposing member 402 which is translating with the conveyance member 201. As the conveyance member 201 is further pulled uphole, the locator block 302B translates with the conveyance member 201 such that the engagement member 302 becomes disposed at an uphole end of the locate profile 502 (see FIGS. 7A, 7B, 7C, and 19C). Because the displacement of the wellbore coupler displacement-opposing member 402, relative to the releasably retained wellbore coupler 304, is being impeded by the displacement impeder 600, such impeding is detected by an operator, at the surface, providing an indication that the wellbore coupler 304 has become releasably retained (i.e. located) relative to the locate profile 502 (e.g. an increase in force required to displace the wellbore coupler 304 from the locate profile 502).

Co-operatively, because the upper and lower castellations 420, 620 are suitably oriented in the first orientation, during the locating stroke, the conveyance member 201 is insufficiently displaced relative to the wellbore coupler 304 such that the second setting cone 218 of the second gripper actuator 216 remains spaced apart from, and does not actuate, the gripper 700.

Upon the detecting of the locating of the locate profile by the shifting tool 100, a downhole force is applied to the wellbore string 504 and transmitted to the conveyance member 201, reversing direction of travel of the conveyance member 201, such that the conveyance member begins travelling in a downhole direction, for purposes of effecting actuation of the gripper 700 for effecting opening of the port 510 associated with the locate profile 502. In this mode, the shifting tool 100 is disposed in the set down mode (see FIGS. 8A, 8B, 8C, and 19F). In reversing direction, the j-pin 406 is displaced relative to the j-slot from the position 220B to position 220C (see FIG. 4). In having the j-pin 406 become displaced from the position 220B to the position 220C, the rotatable mandrel 404 rotates relative to the conveyance member 201, resulting in rotation of the upper castellation 420 relative to the lower castellation 620. The conveyance member 201 becomes sufficiently displaced relative to the wellbore coupler 304 such that the first setting cone 208 of the first gripper actuator 206 actuates the gripper 700. In response to the actuation, the gripper 700 becomes disposed in the first gripping position, such that the first gripper surface 710 is disposed in gripping engagement with the flow control member 506. Compression of the packer 210 between the gauge ring 212 and the first setting cone 208 is effected, resulting in sealing engagement, or substantially sealing engagement, between the packer 210 and the flow control member 506, such that a sealed interface 214 is created within the wellbore.

Once the sealed interface 214 is created, the wellbore is pressurized uphole of the sealed interface 214, establishing a pressure differential across the seal 214, and thereby applying a force that is transmitted by the gripper 700 to the flow control member 506, thereby effecting displacement of the flow control member 506 from the closed position to an open position (see FIGS. 9A, 9B and 9C) such that a port 510 becomes opened for effecting supplying of treatment fluid to the subterranean formation.

In some embodiments, for example, once the subterranean formation has been sufficiently treated by the fluid treatment, an uphole pulling force is applied to the wellbore string 504 and transmitted to the conveyance member 201, such that the conveyance member 201 begins travelling in an uphole direction, for purposes of actuating the gripper 700 to the second gripping position for effecting closing of the flow control member 506, such that the port 510 becomes closed.

In this mode, the shifting tool 100 is disposed in the tension set mode (see FIGS. 10A, 10B, 10C, and 19G). In reversing direction, the j-pin 406 is displaced relative to the j-slot 202 from the position 220C to position 220D (see FIG. 4). In having the j-pin 406 become displaced from the position 220C to the position 220D, the rotatable mandrel 404 rotates relative to the conveyance member 201, and this translates to rotation of the upper castellation 420 relative to the lower castellation 620 such that the upper castellation 420 becomes nested relative to the lower castellation 620 (i.e. the upper and lower castellations 420, 620 becomes disposed in the second orientation), such that impeding of the displacement of the wellbore coupler displacement-opposing member 402, relative to the releasably retained wellbore coupler 304, by the displacement impeder 600, is prevented or substantially prevented. As a result, the conveyance member 201 is sufficiently displaced relative to the wellbore coupler 304 such that: (i) the first setting cone is retracted relative to the gripper 700, and (ii) the second setting cone 218 of the second gripper actuator 216 actuates the gripper 700 such that the gripper 700 becomes disposed in the second gripping position, such that the second gripper surface 712 is disposed in gripping engagement with the flow control member 506. After the gripper 700 has become disposed in the second gripping position, continued application of an uphole pulling force on the workstring, which is translated to the conveyance member 201, effects displacement of the gripper 700 relative to the wellbore such that the gripper 700 urges displacement of the flow control member 506 from the open position to the closed position (see FIGS. 11A, 11B, and 11C).

In some embodiments, for example, prior to the application of the pulling up force to effect the closing of the port 510, the packer is unset so as to drain fluid that is disposed uphole of the packer and which may provide opposition to uphole displacement of the conveyance member 201 and thereby necessitate the application of additional force in order to effect such displacement.

After the closing of the port 510, the second gripper actuator 216 is returned to its original position by, in sequence, running the shifting tool 100 in-hole (see FIGS. 12A, 12B, 12C, and 19A), and then pulling the shifting tool 100 out of hole (see FIGS. 13A, 13B, 13C, and 19B), resulting in the j-pin 402 being displaced within the j-slot between positions 220D, 220A, and 220B. While pulling the shifting tool 100 out-of-hole, the wellbore coupler 304 expands into and becomes releasably retained relative to the same locate profile 502 (see FIGS. 14A, 14B, 14C and 19C) such that the shifting tool 100 becomes seated on the wellbore coupler displacement-opposing member 402 and located, and such that impeding of the relative displacement between the wellbore coupler displacement-opposing member 402 and the wellbore coupler 304 is effected. Eventually, after sufficient uphole displacement of the wellbore coupler displacement-opposing member 402 relative to the wellbore coupler 304, the wellbore coupler 304 becomes unseated relative to the wellbore coupler displacement-opposing member 402, such that the opposition to retraction of the engagement member 302 from the locate profile 502, by the wellbore coupler displacement-opposing member 402, is defeated or substantially defeated, such that retraction of the engagement member 302 requires application of considerably less force to the wellbore coupler 304 by the workstring via the force transmission member 632 (see FIGS. 15A, 15B, 15C, and 19D). As a result, further application of an uphole pulling force on the workstring effects release and retraction of the wellbore coupler 304 from the locate profile 502, such that the wellbore coupler 304 contracts, and the engagement member 302 becomes retracted from the locate profile 502. As a consequence, impeding by the displacement impeder 600 is defeated or substantially defeated (see FIGS. 16A, 16B, and 16C). After the release of the wellbore coupler from the locate profile 502, the wellbore coupler 304 becomes disposed in the collapsed condition such that the wellbore coupler 304 is disposed relative to the wellbore coupler displacement-opposing member 402 such that the wellbore coupler displacement-opposing member 402 is opposing a biasing force exerted by the compressed resilient member 614 on the wellbore coupler 304. As a result, the collet protuberance 302A is urged into engagement with the wellbore coupler displacement-opposing member 402 by the resilient member 614, such that opposing of the biasing force by the wellbore coupler displacement-opposing member 402 is effected by the engagement an engagement surface 302C of the protuberance to a retainer surface 402A of the wellbore coupler displacement-opposing member 402, such that the wellbore coupler displacement-opposing member 402 is opposing the protuberance 302A.

After the wellbore coupler 304 has contracted such that the engagement member 302 becomes retracted from the locate profile 302 and becomes disposed relative to the wellbore coupler displacement-opposing member 402 such that the wellbore coupler displacement-opposing member 402 opposes the biasing force exerted by the resilient member 614 on the wellbore coupler 304, in response to further application of a force (such as, for example, a force in the uphole direction) to the conveyance member 301, the wellbore coupler 304, including the locator block 302B, is displaced relative to the locate profile 502, (such as, for example, when the applied force is in an uphole direction) by virtue of the transmission of the applied force to the wellbore coupler 304 (via the j-pin 406, rotatable mandrel 404, the resilient member 414, the downhole stop 424 of the force transmission member 410, and the collar 308, and/or via the lower castellation 620, the upper castellation 420 (of the force transmission member 410), the downhole stop 424 of the force transmission member 410, and the collar 308), thereby urging the wellbore coupler 304 in an uphole direction, against at least the frictional resistance of the wellbore string 504 versus the wellbore coupler 304, which is resisting the uphole displacement of the wellbore coupler 304, and, eventually, the engagement member 392 becomes disposed in alignment with another locate profile 1502 of the wellbore 500.

Upon the engagement member 302 becoming disposed in alignment with another locate profile 1502, the wellbore coupler 304 expands and the engagement member 302 becomes disposed within the locate profile 502 (see FIGS. 17A, 17B, and 17C). In parallel, the opposition to the biasing force of the compressed resilient member 614 is defeated such that the compressed resilient member 614 effects displacement of the protuberance 302A in a downhole direction relative to the wellbore coupler displacement-opposing member 402, such that the protuberance 302A becomes seated on the wellbore coupler displacement-opposing member 402, and such that the displacement impeder 600 becomes reset and available for actuation to facilitate another locating of the locator 300 (see FIGS. 18A, 18B, 18C, and 19E).

In the above description, for purposes of explanation, numerous details are set forth in order to provide a thorough understanding of the present disclosure. However, it will be apparent to one skilled in the art that these specific details are not required in order to practice the present disclosure. Although certain dimensions and materials are described for implementing the disclosed example embodiments, other suitable dimensions and/or materials may be used within the scope of this disclosure. All such modifications and variations, including all suitable current and future changes in technology, are believed to be within the sphere and scope of the present disclosure. All references mentioned are hereby incorporated by reference in their entirety.

The invention claimed is:

1. A downhole tool comprising:

a locator; and a locator release impeder;

wherein:

the downhole tool is configurable in a locator release-resisting configuration and a locator release-compliant configuration;

in the locator release-resisting configuration, the locator and the locator release impeder are co-operatively oriented such that, while the locator is being retained within a locate profile within a wellbore, and a sufficient force is being applied for releasing the locator from the retention, the locator becomes released from the retention and the releasing is impeded by the locator release impeder for impeding the release;

in the locator release-compliant configuration, the locator and the locator release impeder are co-operatively oriented such that, while the locator is being retained within a locate profile within a wellbore, and a sufficient force is being applied for releasing the locator from the retention, the locator is released from the retention and there is an absence of impeding of the releasing by the locator release impeder; and transition from the locator release-resisting configuration to the locator release-compliant configuration is effectible in response to relative rotation between the locator release impeder and the locator.

2. The downhole tool as claimed in claim 1, further comprising:

a j-tool for mediating the relative rotation between the locator release impeder and the locator.

3. The downhole tool as claimed in claim 1;

wherein:

the locator release impeder includes a first castellation;

the locator includes a second castellation; and the impeding is dependent on orientation of the first castellation relative to the second castellation.

4. The downhole tool as claimed in claim 1, further comprising:

a shifting tool; and a shifting tool actuator configured for actuating the shifting tool;

wherein the shifting tool, the shifting tool actuator, the locator and the locator release impeder are co-operatively configured such that:

while the locator and the locator release impeder are co-operatively disposed in the locator release-resisting configuration, actuation of the shifting tool by the shifting tool actuator is prevented; and while the wellbore coupler release opposer and the locator release impeder are co-operatively disposed in the locator release-compliant configuration, actuation of the shifting tool by the shifting tool actuator is effectible.

5. The downhole tool as claimed in claim 1;

wherein:

the relative rotation between the locator release impeder actuator and the locator is effectible about an axis and in response to a force applied along the axis.

6. A system comprising a wellbore and the downhole tool as claimed in claim 1;

wherein:

the downhole tool is disposed within the wellbore.

7. The system as claimed in claim 6;

wherein:

the wellbore includes the locate profile.

8. The system as claimed in claim 7:

further comprising:

a wellbore string lining the wellbore, wherein the locate profile is defined within the wellbore string.

9. A downhole tool comprising:

a locator including a wellbore coupler displaceable between an extended position and a retracted position;

a wellbore coupler retraction impeder;

wherein:

the downhole tool is configurable in a wellbore coupler retraction-resisting configuration and a wellbore coupler retraction-compliant configuration;

in the wellbore coupler retraction-resisting configuration, the wellbore coupler and the wellbore coupler retraction impeder are co-operatively oriented such that, while the wellbore coupler is disposed in the extended position, and a sufficient force is being applied for retracting the wellbore coupler from the extended position, the wellbore coupler becomes retracted from the extended position and the retraction is impeded by the wellbore coupler retraction impeder;

in the wellbore coupler retraction-compliant configuration, the wellbore coupler and the wellbore coupler retraction impeder are co-operatively oriented such that, while the wellbore coupler is disposed in the extended position, and a sufficient force is being applied for retracting the wellbore coupler from the extended position, the wellbore coupler is retracted from the extended position and there is an absence of impeding of the retraction by the wellbore coupler retraction impeder; and transition from the wellbore coupler retraction-resisting configuration to the wellbore coupler retraction-compliant configuration is effectible in response to relative rotation between the wellbore coupler retraction impeder and the wellbore coupler.

10. The downhole tool as claimed in claim 9, further comprising:

a j-tool for mediating the relative rotation between the wellbore coupler retraction impeder and the wellbore coupler.

11. The downhole tool as claimed in claim 9;

wherein:

the wellbore coupler retraction impeder includes a first castellation;

the wellbore coupler includes a second castellation; and the impeding is dependent on orientation of the first castellation relative to the second castellation.

12. The downhole tool as claimed in claim 9, further comprising:

a shifting tool; and a shifting tool actuator configured for actuating the shifting tool;

wherein the shifting tool, the shifting tool actuator, the wellbore coupler and the wellbore coupler retraction impeder are co-operatively configured such that:

while the wellbore coupler and the wellbore coupler retraction impeder are co-operatively disposed in the wellbore coupler retraction-resisting configuration, actuation of the shifting tool by the shifting tool actuator is prevented; and while the wellbore coupler retraction opposer and the wellbore coupler retraction impeder are co-operatively disposed in the wellbore coupler retraction-compliant configuration orientation, actuation of the shifting tool by the shifting tool actuator is effectible.

13. The downhole tool as claimed in claim 9;

wherein:

the relative rotation between the wellbore coupler retraction impeder actuator and the wellbore coupler is effectible about an axis and in response to a force applied along the axis.

14. A system comprising a wellbore and the downhole tool as claimed in claim 9:

wherein:

the downhole tool is disposed within the wellbore.

15. A downhole tool coupled to a conveying member comprising:

a wellbore coupler displaceable between an extended position and a retracted position; and a wellbore coupler displacement-opposing member configured for opposing displacement of the wellbore coupler from the extended position to the retracted position;

and a frangible member effecting the coupling of the displacement opposing member to the conveying member;

wherein:

the wellbore coupler displacement-opposing member, the conveyance member, the frangible member, and the wellbore coupler are co-operatively configured such that, while seated on the wellbore coupler displacement-opposing member, the wellbore coupler becomes friction locked within the wellbore, coupling of the wellbore coupling displacement-opposing member to the conveyance member is defeatable in response to shearing of the frangible member such that the wellbore coupler becomes movable within the wellbore.

16. A system comprising a wellbore and the downhole tool as claimed in claim 15;

wherein:

the downhole tool is disposed within the wellbore.

* * * * *